US009442403B2

(12) United States Patent
Miyaake et al.

(10) Patent No.: US 9,442,403 B2
(45) Date of Patent: Sep. 13, 2016

(54) TONER, DEVELOPER, AND IMAGE FORMING APPARATUS

(71) Applicants: Azumi Miyaake, Shizuoka (JP); Kazumi Suzuki, Shizuoka (JP); Masana Shiba, Shizuoka (JP); Tatsuya Morita, Kanagawa (JP); Yoshitaka Yamauchi, Shizuoka (JP)

(72) Inventors: Azumi Miyaake, Shizuoka (JP); Kazumi Suzuki, Shizuoka (JP); Masana Shiba, Shizuoka (JP); Tatsuya Morita, Kanagawa (JP); Yoshitaka Yamauchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/421,071

(22) PCT Filed: Aug. 30, 2013

(86) PCT No.: PCT/JP2013/074008
§ 371 (c)(1),
(2) Date: Feb. 11, 2015

(87) PCT Pub. No.: WO2014/038645
PCT Pub. Date: Mar. 13, 2014

(65) Prior Publication Data

US 2015/0220011 A1 Aug. 6, 2015

(30) Foreign Application Priority Data

Sep. 10, 2012 (JP) ..... 2012-198564
Mar. 8, 2013 (JP) ..... 2013-047255

(51) Int. Cl.
*G03G 9/087* (2006.01)
*G03G 9/08* (2006.01)

(52) U.S. Cl.
CPC ..... *G03G 9/08755* (2013.01); *G03G 9/0819* (2013.01); *G03G 9/0821* (2013.01); *G03G 9/0825* (2013.01); *G03G 9/08764* (2013.01); *G03G 9/08788* (2013.01); *G03G 9/08797* (2013.01)

(58) Field of Classification Search
CPC ..... G03G 90/8755; G03G 9/0825; G03G 9/08755
USPC ..... 430/110.1, 109.4
See application file for complete search history.

(56) References Cited

U.S. PATENT DOCUMENTS

| | | | | |
|---|---|---|---|---|
| 6,177,223 | B1 * | 1/2001 | Hashimoto | G03G 9/0821 430/110.1 |
| 7,625,684 | B2 * | 12/2009 | Kamiyoshi | G03G 9/08755 430/109.1 |
| 2004/0152003 | A1 | 8/2004 | Sato et al. | |
| 2009/0068578 | A1 | 3/2009 | Murakami et al. | |
| 2011/0177445 | A1 | 7/2011 | Murata et al. | |
| 2012/0156607 | A1 * | 6/2012 | Farrugia | G03G 9/0804 430/108.4 |
| 2013/0143155 | A1 | 6/2013 | Santo et al. | |
| 2015/0037718 | A1 * | 2/2015 | Morita | G03G 9/0821 430/105 |
| 2015/0153671 | A1 | 6/2015 | Yamauchi et al. | |

FOREIGN PATENT DOCUMENTS

| | | |
|---|---|---|
| EP | 1 901 127 A1 | 3/2008 |
| JP | 02-161471 | 6/1990 |
| JP | 2004-240421 | 8/2004 |
| JP | 2006-133451 | 5/2006 |
| JP | 2010-044161 | 2/2010 |
| JP | 2010-077419 | 4/2010 |
| JP | 2011-123483 | 6/2011 |
| JP | 2011-149999 | 8/2011 |
| JP | 2012-133332 | 7/2012 |
| SU | 1341609 A1 | 1/1986 |
| WO | WO 2006/135041 | 12/2006 |
| WO | WO 2010/027071 | 3/2010 |
| WO | WO 2012/073911 | 6/2012 |
| WO | WO 2013/137368 A1 | 9/2013 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
International Search Report Issued Oct. 1, 2013 for counterpart International Patent Application No. PCT/JP2013/074008 filed Aug. 30, 2013.
Extended European Search Report issued on Aug. 27, 2015 in European Patent Application No. 13834812.3.
Japanese Information Offer Forms issued in Japanese Application No. 2012-205085 dated Nov. 2, 2015 with English Translation.
Office Action issued in corresponding Russian application No. 20151132781(020745), dated Apr. 27, 2016, with English translation, 12 pp.

* cited by examiner

*Primary Examiner* — Christopher Rodee
(74) *Attorney, Agent, or Firm* — Oblon, McClelland, Maier & Neustadt, L.L.P

(57) ABSTRACT

Provided is a toner, including: a crystalline resin; and a colorant, wherein the toner has a sea island structure in which a crystal region containing the crystalline resin is formed as a sea, and a non-crystalline region containing the colorant is formed as an island.

11 Claims, 3 Drawing Sheets

TONER, DEVELOPER, AND IMAGE FORMING APPARATUS

TECHNICAL FIELD

One embodiment according to the present invention relates to a toner, a developer, and an image forming apparatus.

BACKGROUND ART

In the conventional electrophotographic image forming apparatuses, an electrostatic latent image formed on a photoconductor is formed into an apparent image with a toner. For example, an electrostatic latent image is formed on a photoconductor, and the electrostatic latent image is developed with a toner to form a toner image. The toner image is usually transferred onto a transfer paper, and fixed onto the transfer paper.

In fixing the toner image onto the transfer paper, a thermal fixing method such as a heating roller fixing method and a heat belt fixing method is generally used for its energy efficiency.

The recent market increasingly has demanded an image forming apparatus with a higher speed and lower power consumption, leading to a demand for a toner having excellent low-temperature fixing properties. To achieve the low-temperature fixing properties of the toner, the softening temperature of a binder resin contained in the toner needs to be lowered. Meanwhile, a low softening temperature of the binder resin degrades the heat-resistant storage properties of the toner, causing the so-called blocking that is a phenomenon such that toner particles fuse with each other particularly under a high temperature environment.

As a technique for solving this problem, use of a crystalline resin as the binder resin for the toner is known. For example, the crystalline resin can rapidly soften at the melting point. As a result, the softening temperature of the toner can be lowered nearly to the melting point of the crystalline resin while heat-resistant storage properties at the melting point or less are kept. Thus, low-temperature fixing properties and heat-resistant storage properties can be met at the same time.

PTL 1 discloses a resin particle containing a crystalline resin. At this time, the resin particle is produced using an aqueous medium, the largest peak temperature (Ta) of heat of fusion is 40° C. to 100° C., the ratio of the softening point to Ta (softening point/Ta) is 0.8 to 1.55, and the conditions:

$$G'(Ta+20)=1\times10^2 \text{ to } 5\times10^5 \text{ [Pa], and} \quad [1]$$

$$G''(Ta+20)=1\times10^2 \text{ to } 5\times10^5 \text{ [Pa]} \quad [2]$$

[G': storage elastic modulus, and G": loss elastic modulus] are met.

For example, PTL 1 describes a toner as one example of application of the resin particle.

Unfortunately, if such a crystalline resin is used, a pigment is difficult to introduce into the crystalline resin, reducing the saturation of an image.

CITATION LIST

Patent Literature

PTL 1: Japanese Patent Application Laid-Open (JP-A) No. 2010-77419

SUMMARY OF INVENTION

Technical Problem

An object of the present invention is to provide a toner having excellent low-temperature fixing properties and heat-resistant storage properties, and high saturation of an image.

Solution to Problem

The toner according to the present invention as a measure to solve the above problems has a sea island structure in which a crystal region containing a crystalline resin is formed as a sea and a non-crystalline region containing a colorant is formed as an island.

Advantageous Effects of Invention

The present invention can provide a toner having excellent low-temperature fixing properties and heat-resistant storage properties, and high saturation of an image.

DESCRIPTION OF EMBODIMENTS (Toner)

Next, a toner according to one embodiment of the present invention will be described.

Figure 1:
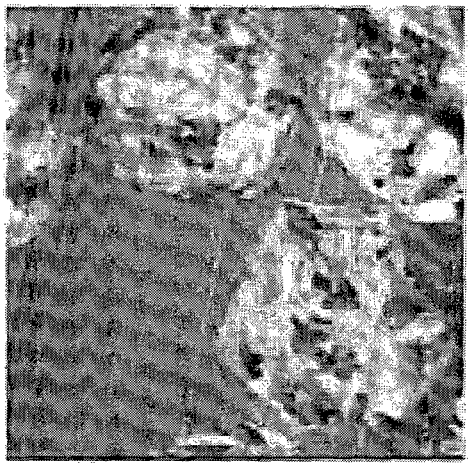
FIG. 1 is a TEM photograph showing a cross section of a toner according to one embodiment of the present invention.

The toner contains a crystalline resin and a colorant, and has a sea island structure in which a crystal region containing the crystalline resin is formed as a sea and a non-crystalline region containing the colorant is formed as an island (see FIG. 1). The colorant is difficult to introduce into the crystalline structure. For this reason, the colorant is contained within the toner by forming islands of a non-crystalline region. At this time, the colorant is preferably uniformly dispersed across the island, but may slightly aggregate and exist in the island.

The dispersion state of the colorant in the toner and the sea island structure of the toner can be seen by observing the cross section of the toner using a transmission electron microscope (TEM). At this time, the obtained image can be contrasted by dyeing the non-crystalline resin with ruthenium tetraoxide. When only the sea island structure is seen, the sea island structure can be more clearly seen by observing a backscattered electron image with a scanning electron microscope (SEM).

The island has a domain diameter of usually 0.5 μm to 2.0 μm, preferably 1.0 μm to 2.0 μm, and more preferably 1.0 μm to 1.5 μm. At a domain diameter of the island less than 0.5 μm, the pigment may not be sufficiently contained within the island, and the colorant may exist unevenly. At a domain diameter of the island of 0.5 μm to 1.0 μm, the colorant may slightly unevenly exist depending on the kind of the colorant dispersed resin or the pigment. At a domain diameter of the island more than 2.0 μm, other components in the toner may be pressed out to the surface of the toner, and may give an influence on toner properties such as heat-resistant storage properties if a colorant dispersed resin having low thermal properties is used.

In the sea island structure, the sea and the island have different volume change rates. For this reason, the toner can be controlled to have an average circularity of 0.985 or less. The volume change rates of the sea and the island can also be adjusted according to the temperature or time in the step of producing the toner. For example, the crystallization rate changes by removing an organic solvent at a temperature lower than the melting point of the crystalline resin. Thereby, the average circularity of the toner can be reduced.

The average circularity of the toner can be measured using an FPIA-3000 (made by Sysmex Corporation).

<Binder Resin>

The binder resin includes a crystalline resin and a colorant dispersed resin.

<<Crystalline Resin>>

The content of the crystalline resin in the binder resin is usually 50% by mass or more, preferably 60% by mass or more, and preferably 70% by mass or more. At a content of the crystalline resin in the binder resin less than 50% by mass, it may be difficult for the toner to have low-temperature fixing properties and heat-resistant storage properties at the same time.

The crystalline resin has a ratio of the softening temperature to the melting point of 0.80 or more and less than 1.55, and rapidly softens by heat.

The melting point can be measured using a differential scanning calorimeter TA-60WS and DSC-60 (made by SHIMADZU Corporation). The softening temperature can be measured using an elevated Flowtester CFT-500 D (made by SHIMADZU Corporation).

The crystalline resin has a melting point of usually 45° C. to 70° C., preferably 53° C. to 65° C., and more preferably 58° C. to 62° C. At a melting point of the crystalline resin less than 45° C., the heat-resistant storage properties of the toner may reduce. At a melting point more than 70° C., the low-temperature fixing properties of the toner may reduce.

The crystalline resin has a ratio of the melting point to the softening temperature of 0.80 to 1.55. The ratio is preferably 0.85 to 1.25, more preferably 0.9 to 1.20, and particularly preferably 0.9 to 1.19. If the crystalline resin has a ratio of the melting point to the softening temperature less than 0.80, the hot offset resistance of the toner reduces. If the ratio is more than 1.55, the low-temperature fixing properties and heat-resistant storage properties of the toner reduce.

The storage elastic modulus G' at a temperature 20° C. higher than the melting point of the crystalline resin is usually, $5.0\times10^6$ Pa·s or less, preferably $1.0\times10^1$ Pa·s to $5.0\times10^5$ Pa·s, and more preferably $1.0\times10^1$ Pa·s to $1.0\times10^4$ Pa·s.

The loss elastic modulus G" at a temperature 20° C. higher than the melting point of the crystalline resin is usually $5.0\times10^6$ Pa·s or less, preferably $1.0\times10^1$ Pa·s to $5.0\times10^5$ Pa·s, and more preferably $1.0\times10^1$ Pa·s to $1.0\times10^4$ Pa·s.

The storage elastic modulus G' and loss elastic modulus G" can be measured using a dynamic rheometer ARES (made by TA Instruments-Waters LLC). Specifically, first, the crystalline resin is molded into a pellet having a diameter of 8 mm and a thickness of 1 to 2 mm, fixed on a parallel plate having a diameter of 8 mm, and stabilized at 40° C. Next, under the condition of the frequency of 1 Hz (6.28 rad/s) and a strain amount of 0.1% (strain amount control mode), the temperature is raised to 200° C. at a temperature raising rate of 2.0° C./min, and the storage elastic modulus G' and the loss elastic modulus G" are measured.

The crystalline resin has a weight average molecular weight of usually, 2,000 to 100,000, preferably 5,000 to 60,000, and more preferably 8,000 to 30,000. At a weight average molecular weight of the crystalline resin less than 2,000, the hot offset resistance of the toner may reduce. At a weight average molecular weight more than 100,000, the low-temperature fixing properties of the toner may reduce.

The weight average molecular weight is a molecular weight measured using a GPC-8220GPC (made by Tosoh Corporation) and converted in terms of polystyrene.

The crystalline resin is not particularly limited. Examples of the crystalline resin include crystalline polyesters, crystalline polyurethanes, crystalline polyureas, crystalline polyamides, crystalline polyethers, crystalline vinyl resins, crystalline urethane modified polyesters, and crystalline urea modified polyesters. These may be used in combinations of two or more. Among these, resins having a crystalline polyester unit are preferably used as the main component because these resins allow design of the melting point suitable for the toner and have high binding properties to paper.

Examples of the resins having a crystalline polyester unit include resins composed of only a crystalline polyester unit (also referred to as a crystalline polyester resin simply), resins including a crystalline polyester unit connected, and resins including a crystalline polyester unit and another polymer bonded thereto (so-called block polymers and graft polymers). The resin composed of only a crystalline polyester unit has many portions having a crystal structure, whereas the resin easily deforms due to an external force. For example, the following causes can be thought. One cause is that the resin easily deforms because all the portions in crystalline polyester are difficult to crystallize while molecular chains in portions not crystallized (non-crystalline sites) have a high degree of freedom. Another cause is that the so-called lamella structure is formed in the portions having a crystal structure; in the higher structure, usually a plane is formed while the molecular chains are folded, and the planes layer one another; between the thus-formed lamella layers, no great binding force works, easily causing deviation of the lamella layers. If the binder resin for a toner easily deforms due to an external force, problems may arise: for example, the toner deforms and aggregates inside of the image forming apparatus, the toner adheres or fixes to a member, and the deformed toner easily scratches an image finally output. For this reason, the binder resin itself has to have resistance against deformation by an external force to some extent and high toughness.

From the viewpoint of giving the toughness of the resin, resins including a crystalline polyester unit connected which has a urethane binding site, a urea binding site, or a phenylene site with large aggregation energy, and resins including a crystalline polyester unit and another polymer bonded thereto (so-called block polymers and graft polymers) are preferable. Among these, particularly the urethane binding site and the urea binding site are preferable because it is thought that the urethane binding site and the urea binding site existing in the molecular chain can form a pseudo crosslinking point in the non-crystalline site or between the lamella layers by a great intermolecular force, and these binding sites make the toner easily wet to a paper even after the toner is fixed onto the paper and can enhance the fixing strength of the toner.

—Crystalline Polyester—

Crystalline polyester can be synthesized by polycondensing polyol and polycarboxylic acid, ring-opening polymerizing lactone, polycondensing hydroxycarboxylic acid, or ring-opening polymerizing a cyclic ester having 4 to 12 carbon atoms that corresponds to a dehydration condensation product of two or three molecules of a hydroxycarboxylic acid. Among these, a polycondensate of diol and dicarboxylic acid is preferable.

For polyol, diol may be used alone, or diol and an alcohol having a valence of 3 or more may be used in combination.

Diol is not particularly limited, and examples thereof include aliphatic diols such as linear aliphatic diols and branched aliphatic diols; alkylene ether glycol having 4 to 36 carbon atoms; alicyclic diols having 4 to 36 carbon atoms; alkylene oxide adducts such as ethylene oxide, propylene oxide, and butylene oxide of alicyclic diols (a number of moles to be added of 1 to 30); alkylene oxide adducts such as ethylene oxide, propylene oxide, and butylene oxide of bisphenols (a number of moles to be added of 2 to 30); polylactone diol; polybutadiene diol; and diols having another functional group such as diols having a carboxyl group, diols having a sulfonic acid group or a sulfamic acid group, and salts thereof. These may be used in combinations of two or more. Among these, aliphatic diols having 2 to 36 carbon atoms in the main chain are preferable, and linear aliphatic diols having 2 to 36 carbon atoms in the main chain are more preferable.

The content of linear aliphatic diol in diol is usually 80 mol % or more, and preferably 90 mol % or more. At a content of linear aliphatic diol in diol less than 80 mol %, it may be difficult for the toner to have low-temperature fixing properties and heat-resistant storage properties at the same time.

Examples of linear aliphatic diols having 2 to 36 carbon atoms in the main chain include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, ethylene glycol, 1,3-propanediol, 1,4-butanediol, 1,6-hexanediol, 1,9-nonanediol, and 1,10-decanediol are preferable.

Examples of branched aliphatic diols having 2 to 36 carbon atoms in the main chain include 1,2-propylene glycol, butanediol, hexanediol, octanediol, decanediol, dodecanediol, tetradecanediol, neopentyl glycol, and 2,2-diethyl-1,3-propanediol.

Examples of alkylene ether glycols having 4 to 36 carbon atoms include diethylene glycol, triethylene glycol, dipropylene glycol, polyethylene glycol, polypropylene glycol, and polytetramethylene ether glycol.

Examples of alicyclic diols having 4 to 36 carbon atoms include 1,4-cyclohexane dimethanol and hydrogenated bisphenol A.

Examples of bisphenols include bisphenol A, bisphenol F, and bisphenol S.

Examples of polylactone diol include poly(ϵ-caprolactone diol).

Examples of diols having a carboxyl group include dialkylol alkanoic acid having 6 to 24 carbon atoms such as 2,2-dimethylolpropionic acid, 2,2-dimethylolbutanoic acid, 2,2-dimethylolheptanoic acid, and 2,2 dimethyloloctanoic acid.

Examples of diols having a sulfonic acid group or sulfamic acid group include N,N-bis(2-hydroxyalkyl)sulfamic acid (alkyl group having 1 to 6 carbon atoms) and alkylene oxide adducts (a number of moles to be added of 1 to 6) thereof such as ethylene oxides, propylene oxides, and butylene oxides thereof, for example, propylene oxide 2 mol adducts of N, N-bis(2-hydroxyethyl)sulfamic acid and N,N-bis(2-hydroxyethyl)sulfamic acid; and bis(2-hydroxyethyl) phosphate.

Examples of a base used for neutralization of salts of diol having a carboxyl group and diol having a sulfonic acid group or a sulfamic acid group include tertiary amines having 3 to 30 carbon atoms such as triethylamine, and hydroxides of alkali metals such as sodium hydroxide.

Among these, alkylene glycols having 2 to 12 carbon atoms, diols having a carboxyl group, and alkylene oxide adducts of bisphenols are preferable.

Polyol having a valence of 3 or more is not particularly limited. Examples thereof include alkane polyols such as glycerol, trimethylolethane, trimethylolpropane, pentaerythritol, sorbitol, sorbitan, and polyglycerols and intramolecular or intermolecular dehydrated products thereof; aliphatic polyalcohols having 3 to 36 carbon atoms such as saccharides such as sucrose and methyl glucoside and derivatives thereof; alkylene oxide adducts (a number of moles to be added of 2 to 30) of trisphenols such as trisphenol PA; alkylene oxide adducts (a number of moles to be added of 2 to 30) of novolak resins such as phenol novolak and cresol novolak; and acrylic polyols such as copolymers of hydroxyethyl (meth)acrylate and other vinyl monomers. Among these, aliphatic polyalcohols having a valence of 3 or more and alkylene oxide adducts of novolak resins are preferable, and alkylene oxide adducts of novolak resins are more preferable.

—Polycarboxylic Acids—

For polycarboxylic acids, dicarboxylic acid may be used alone, or dicarboxylic acid may be used in combination with carboxylic acid having a valence of 3 or more.

Dicarboxylic acid is not particularly limited, and examples thereof include aliphatic dicarboxylic acids such as linear aliphatic dicarboxylic acids and branched aliphatic dicarboxylic acids; and aromatic dicarboxylic acids. Among these, linear aliphatic dicarboxylic acids are preferable.

Examples of aliphatic dicarboxylic acids include alkane dicarboxylic acids having 4 to 36 carbon atoms such as succinic acid, adipic acid, sebacic acid, azelaic acid, dodecanedicarboxylic acid, octadecanedicarboxylic acid, and decylsuccinic acid; alkene dicarboxylic acids having 4 to 36 carbon atoms such as alkenylsuccinic acids such as dodecenylsuccinic acid, pentadecenylsuccinic acid, and octadecenylsuccinic acid, maleic acid, fumaric acid, and citraconic acid; and alicyclic dicarboxylic acids having 6 to 40 carbon atoms such as dimer acids (dimerized linoleic acid).

Examples of aromatic dicarboxylic acids include aromatic dicarboxylic acids having 8 to 36 carbon atoms such as phthalic acid, isophthalic acid, terephthalic acid, t-butylisophthalic acid, 2,6-naphthalene dicarboxylic acid, and 4,4'-biphenyldicarboxylic acid.

Carboxylic acids having a valence of 3 or more are not particularly limited, and examples thereof include aromatic polycarboxylic acids having 9 to 20 carbon atoms such as trimellitic acid and pyromellitic acid.

Instead of polycarboxylic acids, anhydrides of polycarboxylic acids or alkyl esters having 1 to 4 carbon atoms such as methyl ester, ethyl ester, and isopropyl ester may be used.

Among these, aliphatic dicarboxylic acids are preferably used singly, and adipic acid, sebacic acid, dodecanedicarboxylic acid, terephthalic acid, and isophthalic acid are more preferably used singly. At this time, use of aliphatic dicarboxylic acid in combination with aromatic dicarboxylic acid is also preferable, and use of aliphatic dicarboxylic acid in combination with terephthalic acid, isophthalic acid, or t-butylisophthalic acid is also more preferable.

The content of the aromatic dicarboxylic acid in the polycarboxylic acid is preferably 20 mol % or less.

—Lactone Ring-Opening Polymerized Product—

Lactone is not particularly limited, and examples thereof include monolactones having 3 to 12 carbon atoms such as β-propiolactone, γ-butyrolactone, δ-valerolactone, and ϵ-caprolactone. Among these, ϵ-caprolactone is preferable.

In ring-opening polymerization of lactone, a catalyst such as metal oxides and organic metal compounds may be used, or diol such as ethylene glycol and diethylene glycol may be used as an initiator.

Examples of commercially available products of ring-opening polymerized products of lactone include PLACCEL series H1P, H4, H5, and H7 (made by Daicel Corporation).

—Polyhydroxycarboxylic Acid—

Hydroxycarboxylic acid used for polycondensation is not particularly limited, and examples thereof include glycolic acid and lactic acid (for example, L-form, D-form, and racemates).

Hydroxycarboxylic acid used for cyclic ester is not particularly limited, and examples thereof include glycolide and lactide (for example, L-form, D-form, and racemates). Among these, L-lactide and D-lactide are preferable.

In ring-opening polymerization of cyclic ester, a catalyst such as metal oxides and organic metal compounds may be used.

Polyester diol can be synthesized by modifying hydroxycarboxylic acid or a cyclic ester such that the terminal of the polycondensate of the hydroxycarboxylic acid or the ring-opening polymerized product of a cyclic ester has a hydroxyl group or a carboxyl group.

<Resins Including Crystalline Polyester Unit Connected>

Examples of a method for obtaining a resin including a crystalline polyester unit connected include a method in which a crystalline polyester unit having active hydrogen such as a hydroxyl group in the terminal is produced in advance, and connected with polyisocyanate. Use of this unit enables introduction of the urethane binding site into the resin skeleton, enhancing the toughness of the resin.

—Crystalline Polyurethane—

Crystalline polyurethane can be synthesized by polyaddition of polyol and polyisocyanate. Among these, a polyaddition product of diol and diisocyanate is preferable.

For polyols, diols may be used singly, or diols may be used in combination with alcohols having a valence of 3 or more.

For polyols, the same as those used for crystalline polyester can be used.

For polyisocyanate, diisocyanate may be used alone, or diisocyanate may be used in combination with isocyanates having a valence of 3 or more.

Diisocyanate is not particularly limited, and examples thereof include aromatic diisocyanates, aliphatic diisocyanates, alicyclic diisocyanates, and aromatic aliphatic diisocyanates. Examples of these include aromatic diisocyanates having 6 to 20 carbon atoms excluding carbon in the isocyanate group, aliphatic diisocyanates having 2 to 18 carbon atoms excluding carbon in the isocyanate group, alicyclic diisocyanates having 4 to 15 carbon atoms excluding carbon in the isocyanate group, aromatic aliphatic diisocyanates having 8 to 15 carbon atoms excluding carbon in the isocyanate group, and modified products of diisocyanates having a urethane group, a carbodiimide group, an allophanate group, a urea group, a biuret group, a uretdione group, a uretimine group, an isocyanurate group, an oxazolidone group, and the like. These may be used in combinations of two or more.

Examples of aromatic diisocyanates include 1,3-phenylene diisocyanate, 1,4-phenylene diisocyanate, 2,4-tolylene diisocyanate, 2,6-tolylene diisocyanate, crude tolylene diisocyanate, 2,4'-diphenylmethane diisocyanate, 4,4'-diphenylmethane diisocyanate, and crude dip henylmethane diisocyanate (phosgenated products of crude bis(aminophenyl)methane (condensate of formaldehyde with aromatic amine (aniline) or a mixture thereof) and phosgenated products of a mixture of bis(aminophenyl)methane and a small amount (for example, 5 to 20% by mass) of amine having three or more functionalities), 1,5-naphthylene diisocyanate, 4,4',4"-triphenylmethane triisocyanate, m-isocyanatophenylsulfonyl isocyanate, and p-isocyanatophenylsulfonyl isocyanate.

Examples of aliphatic diisocyanates include ethylene diisocyanate, tetramethylene diisocyanate, hexamethylene diisocyanate, dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanatohexanoate.

Examples of alicyclic diisocyanates include isophorone diisocyanate, dicyclohexylmethane-4,4'-diisocyanate, cyclohexylene diisocyanate, methylcyclohexylene diisocyanate, bis(2-isocyanatoethyl)-4-cyclohexene-1,2-dicarboxylate, 2,5-norbornane diisocyanate, and 2,6-norbornane diisocyanate.

Examples of aromatic aliphatic diisocyanates include m-xylylene diisocyanate, p-xylylene diisocyanate, and α,α,α',α'-tetramethylxylylene diisocyanate.

Examples of modified products of diisocyanates include modified diphenylmethane diisocyanates such as urethane modified diphenylmethane diisocyanate, carbodiimide modified diphenylmethane diisocyanate, and trihydrocarbyl phosphate modified diphenylmethane diisocyanate; and modified products of diisocyanate such as urethane modified tolylene diisocyanate such as prepolymers having an isocyanate group.

Among these, aromatic diisocyanates having 6 to 15 carbon atoms excluding carbon in the isocyanate group, aliphatic diisocyanates having 4 to 12 carbon atoms excluding carbon in the isocyanate group, and alicyclic diisocyanates having 4 to 15 carbon atoms excluding carbon in the isocyanate group are preferable, and tolylene diisocyanate, diphenylmethane diisocyanate, hexamethylene diisocyanate, hydrogenated diphenylmethane diisocyanate, and isophorone diisocyanate are more preferable.

—Crystalline Polyurea—

Crystalline polyurea can be synthesized by polyaddition of polyamine and polyisocyanate. Among these, polyaddition products of diamine and diisocyanate are preferable.

For polyisocyanate, diisocyanate may be used alone, or diisocyanate may be used in combination with isocyanate having a valence of 3 or more.

For polyisocyanate, the same as those used for crystalline polyurethane can be used.

For polyamine, diamine may be used alone, or diamine may be used in combination with amine having a valence of 3 or more.

Polyamine is not particularly limited, and examples thereof include aliphatic polyamines and aromatic polyamines. Among these, aliphatic polyamines having 2 to 18 carbon atoms and aromatic polyamines having 6 to 20 carbon atoms are preferable.

Examples of aliphatic polyamines having 2 to 18 carbon atoms include alkylenediamines having 2 to 6 carbon atoms such as ethylenediamine, propylenediamine, trimethylenediamine, tetramethylenediamine, and hexamethylenediamine; polyalkylene polyamines having 4 to 18 carbon atoms such as diethylenetriamine, iminobis(propylamine), bis(hexamethylene)triamine, triethylenetetramine, tetraethylenepentamine, and pentaethylenehexamine; alkylenediamines or polyalkylenediamines substituted by alkyl having 1 to 4 carbon atoms or hydroxyalkyl having 2 to 4 carbon atoms such as dialkylaminopropylamine, trimethylhexamethylenediamine, aminoethylethanolamine, 2,5-dimethyl-2,5-hexamethylenediamine, and methyliminobis(propylamine); alicyclic diamines having 4 to 15 carbon atoms such as 1,3-diaminocyclohexane, isophoronediamine, mentheneediamine, and 4,4'-methylenedicyclohexanediamine (hydrogenated methylenedianiline); heterocyclic diamines having 4 to 15 carbon atoms such as piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane; and aromatic ring-containing aliphatic diamines having 8 to 15 carbon atoms such as xylylenediamine and tetrachloro-p-xylylenediamine.

Examples of aromatic diamines having 6 to 20 carbon atoms include non-substituted aromatic diamines such as 1,2-phenylenediamine, 1,3-phenylenediamine, 1,4-phenylenediamine, 2,4'-diphenylmethanediamine, 4,4'-diphenylmethanediamine, crude diphenylmethanediamine (polyphenylpolymethylenepolyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, and naphthylenediamine; aromatic diamines having a nucleus substituted alkyl group with 1 to 4 carbon atoms such as 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenylether, and 3,3',5,5'-tetraisopropyl-4,4'-diaminodiphenylsulfone; methylenebis(o-chloroaniline), 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, and 3-dimethoxy-4-aminoaniline; halo groups such as a chloro group, a bromo group, an iodo group, and a fluoro group such as 4,4'-diamino-3,3'-dimethyl-5,5'-dibromodiphenylmethane, 3,3'-dichlorobenzidine, 3,3'-dimethoxy benzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline; alkoxy groups such as a methoxy group and an ethoxy group; aromatic diamines having a nucleus substituted electron-withdrawing group such as a nitro group; and aromatic diamines having a secondary amino group such as 4,4'-bis(methylamino)diphenylmethane and 1-methyl-2-methylamino-4-aminobenzene (non-substituted aromatic diamines, aromatic diamines having a nucleus substituted alkyl group with 1 to 4 carbon atoms, and aromatic diamines having a nucleus substituted electron-withdrawing group in which a primary amino group is partially or entirely substituted by a lower alkyl group such as a methyl group and an ethyl group).

Examples of diamines other than these include polyamide polyamines such as polyamide polyamine synthesized by condensing dicarboxylic acid such as dimer acid and an excessive amount (2 or more mol per mol of dicarboxylic acid) of polyamine such as alkylenediamine and polyalkylene polyamine; and polyether polyamines such as hydrides of cyanoethylated products of polyether polyol such as polyalkylene glycol.

Instead of polyamine, ketimine and oxazolidone in which an amino group in polyamine is blocked by a ketone such as acetone, methyl ethyl ketone, and methyl isobutyl ketone may be used, for example.

—Crystalline Polyamide—

Crystalline polyamide can be synthesized by polycondensing polyamine and polycarboxylic acid. Among these, a polycondensate of diamine and dicarboxylic acid is preferable.

For polyamine, diamine may be used alone, or diamine may be used in combination with amine having a valence of 3 or more.

For polyamine, the same as those used for polyurea can be used.

For polycarboxylic acid, dicarboxylic acid may be used alone, or dicarboxylic acid may be used in combination with carboxylic acid having a valence of 3 or more.

For polycarboxylic acids, the same as those used for polyester can be used.

—Crystalline Polyether—

Crystalline polyether is not particularly limited, and examples thereof include crystalline polyoxyalkylene polyols.

A method for synthesizing crystalline polyoxyalkylene polyol is not particularly limited. Examples thereof include a method of ring-opening polymerizing chiral alkylene oxide using a catalyst (for example, see Journal of the American Chemical Society, 1956, vol. 78, No. 18, p. 4787-4792), and a method for ring-opening polymerizing racemic alkylene oxide using a catalyst.

Examples of the method for ring-opening polymerizing racemic alkylene oxide using a catalyst include a method using a compound prepared by contacting a lanthanoid complex with organic aluminum as a catalyst (for example, see Japanese Patent Application Laid-Open (JP-A) No. 11-12353), and a method for reacting bimetal μ-oxoalkoxide with a hydroxyl compound in advance (for example, see Japanese Patent Application Laid-Open (JP-A) No. 2001-521957).

Further, examples of a method for synthesizing high isotactic polyoxyalkylene polyol include a method using a salen complex as a catalyst (for example, see Journal of the American Chemical Society, 2005, vol. 127, No. 33, p. 11566-11567). For example, by ring-opening polymerizing chiral alkylene oxide using diol or water as an initiator, polyoxyalkylene glycol having a hydroxyl group in the terminal and an isotacticity of 50% or more can be synthesized. Polyoxyalkylene glycol having an isotacticity of 50% or more may be modified using dicarboxylic acid such that the terminal is a carboxyl group. At an isotacticity of 50% or more, usually crystallinity is obtained.

For diol, the same as those used for crystalline polyester can be used.

For dicarboxylic acid, the same as those used for crystalline polyester can be used.

Alkylene oxide is not particularly limited. Examples thereof include alkylene oxides having 3 to 9 carbon atoms such as propylene oxide, 1-chlorooxetane, 2-chlorooxetane, 1,2-dichlorooxetane, epichlorohydrin, epibromohydrin, 1,2-butylene oxide, methyl glycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allyl glycidyl ether, 1,2-heptylene oxide, styrene oxide, and phenyl glycidyl ether. These may be used in combinations of two or more. Among these, propylene oxide, 1,2-BO, styrene oxide, and cyclohexene oxide are preferable, and PO, 1,2-butylene oxide, and cyclohexene oxide are preferable.

The isotacticity of crystalline polyoxyalkylene polyol is usually 70% or more, preferably 80% or more, more preferably 90% or more, and particularly preferably 95% or more.

The isotacticity can be calculated using the method described in Macromolecules, vol. 35, No. 6, p. 2389-2392 (2002).

Approximately 30 mg of a sample for measurement is weighed and placed in a sample tube for $^{13}$C-NMR having a diameter of 5 mm. Approximately 0.5 mL of a deuterated solvent is added, and the sample is dissolved. The obtained solution is used as a sample for analysis. Here, the deuterated solvent is not particularly limited, and any solvent that can dissolve the sample can be properly selected. Examples thereof include deuterochloroform, deuterated toluene, deuterated dimethyl sulfoxide, and deuterated dimethylformamide. The signals in $^{13}$C-NMR derived from three methine groups are observed at a syndiotactic value (S) in the vicinity of 75.1 ppm, a heterotactic value (H) in the vicinity of 75.3 ppm, and an isotactic value (I) in the vicinity of 75.5 ppm.

The isotacticity is calculated by the following calculation expression (1):

$$\text{isotacticity (\%)}=[I/(I+S+H)]\times 100 \quad (1)$$

wherein I represents the integrated value of the isotactic signal, S represents the integrated value of the syndiotactic signal, and H represents the integrated value of the heterotactic signal.

—Crystalline Vinyl Resin—

The crystalline vinyl resin can be synthesized by addition polymerization of a crystalline vinyl monomer when necessary with a non-crystalline vinyl monomer.

The crystalline vinyl monomer is not particularly limited, and examples thereof include alkyl (meth)acrylate having a linear alkyl group with 12 to 50 carbon atoms such as lauryl (meth)acrylate, tetradecyl (meth)acrylate, stearyl (meth) acrylate, eicosyl (meth)acrylate, and behenyl (meth)acrylate. These may be used in combinations of two or more.

The non-crystalline vinyl monomer is not particularly limited. Examples thereof include vinyl monomers having a molecular weight of 1,000 or less such as styrenes, (meth) acrylate esters, vinyl monomer having a carboxyl group, vinyl esters, and aliphatic hydrocarbon vinyl monomers. These may be used in combinations of two or more.

Examples of styrenes include styrene, and alkyl styrenes having an alkyl group with 1 to 3 carbon atoms.

Examples of (meth)acrylate esters include alkyl (meth) acrylates having a linear alkyl group with 1 to 11 carbon atoms such as methyl (meth)acrylate, ethyl (meth)acrylate, and butyl (meth)acrylate; alkyl (meth)acrylates having a branched alkyl group with 12 to 18 carbon atoms such as 2-ethylhexyl(meth)acrylate; hydroxyalkyl(meth)acrylates having a hydroxyalkyl group with 1 to 11 carbon atoms such as hydroxylethyl(meth)acrylate; and dialkylaminoalkyl (meth)acrylates having a dialkyl aminoalkyl group with 1 to 11 carbon atoms such as dimethylaminoethyl(meth)acrylate and diethylaminoethyl(meth)acrylate.

Examples of vinyl monomers having a carboxyl group include monocarboxylic acids having 3 to 15 carbon atoms such as (meth)acrylic acid, crotonic acid, and cinnamic acid; dicarboxylic acids having 4 to 15 carbon atoms such as (anhydrous) maleic acid, fumaric acid, itaconic acid, and citraconic acid; and dicarboxylic acid monoalkyl esters having an alkyl group with 1 to 18 carbon atoms such as maleic acid monoalkyl ester, fumaric acid monoalkyl ester, itaconic acid monoalkyl ester, and citraconic acid monoalkyl ester.

Examples of vinyl esters include aliphatic vinyl esters having 4 to 15 carbon atoms such as vinyl acetate, vinyl propionate, and isopropenyl acetate; unsaturated carboxylic acid polyhydric alcohol esters having 8 to 50 carbon atoms such as ethylene glycol di(meth)acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate; and vinyl esters of aromatic carboxylic acids having 9 to 15 carbon atoms such as methyl-4-vinyl benzoate.

Examples of aliphatic hydrocarbon vinyl monomers include olefins having 2 to 10 carbon atoms such as ethylene, propylene, butene, and octene; and dienes having 4 to 10 carbon atoms such as butadiene, isoprene, and 1,6-hexadiene.

—Crystalline Resin Containing Urethane Bond, Urea Bond or Both in Main Chain Thereof—

Examples of a method for obtaining a resin obtained by connecting a unit of crystalline urethane modified polyester, crystalline urea modified polyester, or the like in which crystalline polyester is partially modified include a method in which a crystalline polyester unit having active hydrogen such as a hydroxyl group in the terminal is produced in advance, and connected with polyisocyanate. Use of this unit enables introduction of the urethane binding site into the resin skeleton, enhancing the toughness of the resin.

Examples of polyisocyanate include diisocyanates, and polyisocyanates having a valence of 3 or more.

The diisocyanates are not particularly limited, and can be properly selected according to the purpose. Examples thereof include aromatic diisocyanates, aliphatic diisocyanates, alicyclic diisocyanates, and aromatic aliphatic diisocyanates. Among these, aromatic diisocyanates having 6 to 20 carbon atoms excluding carbon in an NCO group, aliphatic diisocyanates having 2 to 18 carbon atoms excluding carbon in an NCO group, alicyclic diisocyanates having 4 to 15 carbon atoms excluding carbon in an NCO group, aromatic aliphatic diisocyanates having 8 to 15 carbon atoms excluding carbon in an NCO group, modified products of these diisocyanates (such as modified products containing a urethane group, carbodiimide group, allophanate group, urea group, biuret group, uretdione group, uretimine group, isocyanurate group, or oxazolidone group), and a mixture of two or more thereof are preferable. These may be used in combination with isocyanate having a valence of 3 or more when necessary.

The aromatic diisocyanates are not particularly limited, and can be properly selected according to the purpose.

Examples thereof include 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [phosgenated products of crude diaminophenylmethane [condensation products of formaldehyde and aromatic amine (aniline) or a mixture thereof; a mixture of diaminodiphenylmethane and a small amount of (for example, 5 to 20% by mass) of polyamine having three or more functionalities]: polyallyl polyisocyanate (PAPI)], 1,5-naphthylene diisocyanate, 4,4',4"-triphenylmethane triisocyanate, and m- and p-isocyanatophenylsulfonyl isocyanates.

The aliphatic diisocyanates are not particularly limited, and can be properly selected according to the purpose. Examples thereof include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanatohexanoate.

The alicyclic diisocyanates are not particularly limited, and can be properly selected according to the purpose. Examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornane diisocyanates.

The aromatic aliphatic diisocyanates are not particularly limited, and can be properly selected according to the purpose. Examples thereof include m- and p-xylylene diisocyanates (XDI), and $\alpha,\alpha,\alpha',\alpha'$-tetramethylxylylene diisocyanate (TMXDI).

The modified products of diisocyanates are not particularly limited, and can be properly selected according to the purpose. Examples thereof include modified products containing a urethane group, carbodiimide group, allophanate group, urea group, biuret group, uretdione group, uretimine group, isocyanurate group, or oxazolidone group. Specifically, examples of the modified products of diisocyanates include the modified products of diisocyanates such as modified MDIs such as urethane modified MDI, carbodiimide modified MDI, and trihydrocarbyl phosphate modified MDI; and urethane modified TDI such as isocyanate-containing prepolymers; and a mixture of two or more of these modified products of diisocyanates (such as modified MDI used in combination with urethane modified TDI).

Among these diisocyanates, aromatic diisocyanates having 6 to 15 carbon atoms excluding carbon in an NCO group, aliphatic diisocyanates having 4 to 12 carbon atoms excluding carbon in an NCO group, and alicyclic diisocyanates having 4 to 15 carbon atoms excluding carbon in an NCO group are preferable, and TDI, MDI, HDI, hydrogenated MDI, and IPDI are particularly preferable.

Examples of a method for obtaining a resin including a crystalline polyester unit and another polymer bonded thereto include a method in which the crystalline polyester unit and the another polymer unit are separately produced in advance, and are bonded; a method in which one of the crystalline polyester unit and the another polymer unit is produced in advance, and the other polymer is polymerized in the presence of the produced unit; or a method in which the crystalline polyester unit and the another polymer unit are polymerized in the same reaction place simultaneously or successively. The first or second method is preferable because the reaction is easily controlled as intended design.

Examples of the first method include a method in which a unit having active hydrogen such as a hydroxyl group in the terminal is produced in advance, and connected with polyisocyanate, in addition to the above method for obtaining a resin including a crystalline polyester unit connected. For polyisocyanate, those described above can be used. Meanwhile, polyisocyanate can also be obtained by a method in which an isocyanate group is introduced into the terminal of one unit, and reacted with active hydrogen in the other unit. Use of this unit enables introduction of the urethane binding site into the resin skeleton, enhancing the toughness of the resin.

For the second method, if the crystalline polyester unit is produced first and the polymer unit to be produced next is a non-crystalline polyester unit, a polyurethane unit, a polyurea unit, or the like, a hydroxyl group or carboxyl group in the terminal of the crystalline polyester unit is reacted with a monomer for obtaining another polymer unit. Thereby, a resin including a crystalline polyester unit and another polymer bonded thereto can be obtained.

Examples of the non-crystalline polyester unit include a polycondensation polyester unit synthesized from polyol and polycarboxylic acid. For polyol and polycarboxylic acid, those exemplified in the description of the crystalline polyester unit above can be used. To design so as to eliminate crystallinity, the polymer skeleton may have many flexible points and branch points. To provide flexible points, for example, bisphenol such as an AO (such as EO, PO, and BO) adduct (a number of moles to be added of 2 to 30) of bisphenol A, bisphenol F, bisphenol S, or the like and derivatives thereof are used as polyol, and phthalic acid, isophthalic acid, and t-butyl isophthalic acid are used as polycarboxylic acid. To introduce the branch points, polyol and polycarboxylic acid having a valence of 3 or more may be used.

Examples of the polyurethane unit include polyurethane units synthesized from polyols such as diol and polyols having a valence of 3 to 8 or more, and polyisocyanate such as diisocyanate and polyisocyanate having a valence of 3 or more. Among these, the polyurethane unit synthesized from the diol and the diisocyanate is preferable.

Examples of polyols such as the diol and the polyols having a valence of 3 to 8 or more include the same as those listed in the description of the polyester resin above.

Examples of the diisocyanate and the polyisocyanate having a valence of 3 or more include the same as those described above.

Examples of the polyurea unit include polyurea units synthesized from polyamine such as diamine and polyamine having a valence of 3 or more and polyisocyanate such as diisocyanate and polyisocyanate having a valence of 3 or more.

The diamine is not particularly limited, and can be properly selected according to the purpose. Examples thereof include aliphatic diamines and aromatic diamines. Among these, aliphatic diamines having 2 to 18 carbon atoms, and aromatic diamines having 6 to 20 carbon atoms are preferable. The amines having a valence of 3 or more may be used when necessary.

The aliphatic diamines having 2 to 18 carbon atoms are not particularly limited, and can be properly selected according to the purpose. Examples thereof include alkylenediamines having 2 to 6 carbon atoms such as ethylenediamine, propylenediamine, trimethylenediamine, tetramethylenediamine, and hexamethylenediamine; polyalkylenediamines having 4 to 18 carbon atoms such as diethylenetriamine, iminobispropylamine, bis(hexamethylene)triamine, triethylenetetramine, tetraethylenepentamine, and pentaethylenehexamine; alkylenediamines or polyalkylenediamines substituted by alkyls having 1 to 4 carbon atoms or hydroxyalkyl having 2 to 4 carbon atoms such as dialkylaminopropylamine, trimethylhexamethylenediamine, aminoethylethanolamine, 2,5-dimethyl-2,5-hexamethylenediamine, and methyliminobispropylamine; alicyclic diamines having 4 to 15 carbon atoms such as 1,3-diaminocyclohexane, isophoronediamine, menthenediamine, and 4,4'-methylenedicyclohexanediamine (hydrogenated methylenedianiline); heterocyclic diamines having 4 to 15 carbon atoms such as piperazine, N-aminoethylpiperazine, 1,4-diaminoethylpiperazine, 1,4-bis(2-amino-2-methylpropyl) piperazine, and 3,9-bis(3-aminopropyl)-2,4,8,10-tetraoxaspiro[5,5]undecane; and aromatic ring-containing aliphatic amines having 8 to 15 carbon atoms such as xylylenediamine and tetrachloro-p-xylylenediamine.

The aromatic diamines having 6 to 20 carbon atoms are not particularly limited, and can be properly selected according to the purpose. Examples thereof include non-substituted aromatic diamines such as 1,2-, 1,3-, and 1,4-phenylenediamines, 2,4'- and 4,4'-diphenylmethanediamines, crude diphenylmethanediamine (polyphenylpolymethylenepolyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, and naphthylenediamine; aromatic diamines having a nucleus substituted alkyl group with 1 to 4 carbon atoms such as 2,4- and 2,6-tolylenediamines, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenylether, and 3,3',5,5'-tetraisopropyl-4,4'-diaminodiphenylsulfone; mixtures of isomers of the non-substituted aromatic diamines or the aromatic diamines having a nucleus substituted alkyl group with 1 to 4 carbon atoms in various proportions; methylenebis(o-chloroaniline), 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, and 3-dimethoxy-4-aminoaniline; aromatic diamines having a nucleus substituted electron-withdrawing group (for example, a halogen such as Cl, Br, I, and F; an alkoxy group such as methoxy and ethoxy; and a nitro group) such as 4,4'-diamino-3,3'-dimethyl-5,5'-dibromodiphenylmethane, 3,3'-dichlorobenzidine, 3,3'-dimethoxy benzidine, bis(4-amino-3-chlorophenyl)oxide, bis(4-amino-2-chlorophenyl) propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline; and aromatic diamines having a secondary amino group such as 4,4'-di(methylamino)diphenylmethane and 1-methyl-2-methylamino-4-aminobenzene [the non-substituted aromatic diamines, aromatic diamines having a nucleus substituted alkyl group with 1 to 4 carbon atoms, and mixtures of isomers thereof in various proportions, and aromatic diamines having a nucleus substituted electron-withdrawing group in which a primary amino group is partially or entirely substituted by a secondary amino group using a lower alkyl group such as methyl and ethyl].

Besides these, examples of the diamines include polyamide polyamines such as low molecular weight polyamide polyamines obtained by condensing dicarboxylic acid (such as dimer acid) and an excessive amount (2 or more mol per mol of an acid) of the polyamine (such as the alkylenediamines and the polyalkylene polyamines); and polyether polyamines such as hydrides of cyanoethylated products such as polyether polyol (such as polyalkylene glycol).

Amine compounds whose amino group is capped by a ketone compound may be used.

Among these, polyurea units synthesized from the diamines and the diisocyanates are preferable.

Examples of the diisocyanate and the polyisocyanate having a valence of 3 or more include the same as those above.

The binder resin preferably contains a crystalline resin containing a urea bond in the main chain thereof. According to Solubility Parameter Values (Polymer handbook 4th Ed), the urea bond has an aggregation energy of 50,230 [J/mol], which is approximately twice the aggregation energy of the urethane bond (26,370 [J/mol]). For this reason, at even a small amount of the urea bond, the effect of improving the toughness of the toner and offset resistance during fixing can be expected.

Examples of a method to obtain the resin containing the urea bond in the main chain thereof include a method in which a polyisocyanate compound is reacted with a polyamine compound or water to generate an amino group by hydrolysis of isocyanate, and the amino group is reacted with the remaining isocyanate group. In obtaining the resin having the urea bond in the main chain, besides the compounds above, a polyol compound can also be reacted at the same time. This reaction can increase the degree of freedom of design of the resin.

For polyisocyanate, in addition to the diisocyanate and polyisocyanate having a valence of 3 or more as described above (hereinafter, also written as the low molecular weight polyisocyanate), polymers having an isocyanate group in the terminal or the side chain (hereinafter, also written as a prepolymer) may be used.

Examples of the method for synthesizing a prepolymer include a method in which the low molecular weight polyisocyanate is reacted with a polyamine compound described later at an excessive amount of isocyanate to obtain a polyurea prepolymer having an isocyanate group in the terminal, and a method in which the low molecular weight polyisocyanate is reacted with a polyol compound at an excessive amount of isocyanate to obtain a prepolymer having an isocyanate group in the terminal. These prepolymers obtained by these methods may be used singly. Two or more prepolymers obtained by the same method or two or more prepolymers obtained by the two methods may be used in combination. Further, one of the prepolymers and one of the low molecular weight polyisocyanates may be used, or two or more of the prepolymers and two or more of the low molecular weight polyisocyanates may be used in combination.

The ratio of polyisocyanate to be used is usually 5/1 to 1.01/1, preferably 4/1 to 1.2/1, and more preferably 2.5/1 to 1.5/1 as an equivalent ratio $[NCO]/[NH_2]$ of an isocyanate group [NCO] to an amino group in polyamine $[NH_2]$ or an equivalent ratio [NCO]/[OH] of an isocyanate group [NCO] to a hydroxyl group [OH] in polyol. At a molar ratio of [NCO] of more than 5, the amounts of the urethane bond and the urea bond are excessively large. If the resin to be finally obtained is used as a binder resin for a toner, the elastic modulus in the melting state is excessively high, and fixing properties may be degraded. At a molar ratio of [NCO] of less than 1.01, the degree of polymerization is high and the molecular weight of the prepolymer to be produced is larger. For this reason, such a prepolymer is difficult to mix with other materials in production of the toner, or the elastic modulus in the melting state is excessively high, and fixing properties may be degraded. For these reasons, a molar ratio of [NCO] of more than 5 and a molar ratio of less than 1.01 are not preferable.

Examples of polyamine include the diamines and polyamines having a valence of 3 or more described above.

For polyol, in addition to the diol and polyols having a valence of 3 to 8 or more as described above (hereinafter, also written as low molecular weight polyol), polymers having a hydroxyl group in the terminal or the side chain (hereinafter, also written as high molecular weight polyol) may be used.

Examples of a method for producing high molecular weight polyol include a method in which a low molecular weight polyisocyanate is reacted with a low molecular weight polyol at an excessive amount of a hydroxyl group to obtain polyurethane having a hydroxyl group in the terminal, and a method in which a polycarboxylic acid is reacted with a low molecular weight polyol compound at an excessive amount of a hydroxyl group to obtain polyester having a hydroxyl group in the terminal.

To prepare polyurethane or polyester having a hydroxyl group in the terminal, a ratio [OH]/[NCO] of the low molecular weight polyol to the low molecular weight polyisocyanate or a ratio [OH]/[COOH] of the low molecular weight polyol to the polycarboxylic acid is usually 2/1 to 1/1, preferably 1.5/1 to 1/1, and more preferably 1.3/1 to 1.02/1.

At a molar ratio of the hydroxyl group of more than 2, the polymerization reaction does not progress, and a desired high molecular weight polyol is not obtained. At a molar ratio of less than 1.02, the degree of polymerization is higher and the molecular weight of the high molecular weight polyol is larger. For this reason, such a high molecular weight polyol is difficult to mix with other materials in production of the toner, or the elastic modulus in the melting state is excessively high, and fixing properties may be degraded. For these reasons, a molar ratio of more than 2 and a molar ratio of less than 1.02 are not preferable.

Examples of the polycarboxylic acids include the dicarboxylic acids and polycarboxylic acids having a valence of 3 to 6 or more described above.

For the obtained resin to have crystallinity, a crystalline polymer unit may be introduced into the main chain of the resin. Examples of crystalline polymer units having a suitable melting point as the binder resin for a toner include crystalline polyester units and long-chain alkyl ester units of polyacrylic acids and polymethacrylic acids. The crystalline polyester units are preferable because those having terminal alcohol can be easily produced, and the crystalline polyester units can be easily introduced into the resin having the urea bond as a polyol compound.

Examples of the crystalline polyester unit include polycondensation polyester units synthesized from polyols and polycarboxylic acids, lactone ring-opening polymerized products, and polyhydroxycarboxylic acids. Among these, polycondensation polyester units of diol and dicarboxylic acid are preferable from the viewpoint of exhibition of crystallinity.

For diol, diols listed in the description of polyols above can be used. Among these, aliphatic diols having 2 to 36 chain carbon atoms are preferable, and linear aliphatic diols are more preferable. These may be used singly or in combinations of two or more. Among these, ethylene glycol, 1,3-propanediol, 1,4-butanediol, 1,6-hexanediol, 1,9-nonanediol, and 1,10-decanediol are preferable considering availability.

The content of the linear aliphatic diol based on the diol in total is preferably 80 mol % or more, and more preferably 90 mol % or more. A content of 80 mol % or more is preferable because the crystallinity of the resin tends to be improved, low-temperature fixing properties and heat-resistant storage properties are tend to be well met at the same time, and the hardness of the resin tends to be improved.

For dicarboxylic acid, the dicarboxylic acids listed in the description of the polycarboxylic acids described above can be used. Among these, linear aliphatic dicarboxylic acids are more preferable.

Among these dicarboxylic acids, the aliphatic dicarboxylic acids (preferably, adipic acid, sebacic acid, dodecane dicarboxylic acid, terephthalic acid, isophthalic acid, and the like) particularly preferably used singly. The aliphatic dicarboxylic acid copolymerized with the aromatic dicarboxylic acids (preferably, terephthalic acid, isophthalic acid, t-butyl isophthalic acid, and the like; and lower alkyl esters of these aromatic dicarboxylic acids, and the like) is also preferable. The amount of the aromatic dicarboxylic acid for copolymerization is preferably 20 mol % or less.

A resin having a urea bond formed in advance is used as the binder resin, and mixed with toner forming materials other than the binder resin such as a colorant, a mold release agent, and a charge control agent. The obtained mixture is formed into particles. Thus, a toner can be obtained. The urea bond may be formed by mixing a polyisocyanate compound, a polyamine compound, and/or water with the toner forming materials other than the binder resin such as a colorant, a mold release agent, and a charge control agent when necessary. Particularly, by using the prepolymer as the polyisocyanate compound, a crystalline resin having a high molecular weight urea bond can be uniformly introduced into the toner. Thereby, the toner has uniform thermal properties and charging properties, and has fixing properties and stress resistance at the same time easily. Thus, use of the prepolymer is preferable. Further, a preferable prepolymer is a prepolymer obtained by reacting the low molecular weight polyisocyanate with the polyol compound at an excessive amount of isocyanate because viscoelasticity is suppressed. A preferable polyol compound is a polyester having a hydroxyl group in the terminal obtained by reacting the polycarboxylic acid with the low molecular weight polyol compound at an excessive amount of a hydroxyl group because thermal properties suitable for the toner is easily obtained. Further, when the polyester is composed of a crystalline polyester unit, the high molecular weight component in the toner is sharp melt, and a toner having excellent low-temperature fixing properties is attained. For this reason, such a polyester is preferable.

When the toner is obtained by granulation in an aqueous medium, water as a dispersion medium reacts with the polyisocyanate compound. Thereby, the urea bond can be formed under mild conditions.

The binder resins may be used singly or in combinations of two or more. The binder resins having different weight average molecular weights may be used in combination. Preferably, at least a first crystalline resin and a second crystalline resin having a weight average molecular weight Mw larger than that of the first crystalline resin are contained because the toner can have excellent low-temperature fixing properties and hot offset resistance at the same time.

Preferably, the second crystalline resin is prepared by using the binder resin precursor that is a modified crystalline resin having an isocyanate group, and reacting the precursor with a compound having an active hydrogen group to extend the resin. In this case, the reaction of the binder resin precursor with the compound having an active hydrogen group is more preferably performed during production of the toner. Thereby, the crystalline resin having a larger weight average molecular weight can be uniformly dispersed in the toner to suppress fluctuation of properties between the toner particles.

Further, preferably, the first crystalline resin is a crystalline resin containing the urethane bond, urea bond or both in the main chain thereof, and the second crystalline resin is prepared by reacting the binder resin precursor obtained by modifying the first crystalline resin with the compound having an active hydrogen group to extend the resin. If the composition structure of the first crystalline resin is close to that of the second crystalline resin, the two binder resins can be more uniformly dispersed in the toner easily to further suppress fluctuation of properties between the toner particles.

For the crystalline resin, the crystalline resin may be used in combination with a non-crystalline resin. The main component of the binder resin is preferably the crystalline resin.

<<Colorant Dispersed Resin>>

The resin for dispersing a colorant is not particularly limited as long as the sea island structure can be formed in which the crystal region containing a crystalline resin is formed as a sea and the non-crystalline region containing a colorant is formed as an island. Examples thereof include non-crystalline resins, and block copolymers having a crystalline block and a non-crystalline block.

Among these, block copolymers having a crystalline block and a non-crystalline block are preferable.

The colorant dispersed resin is preferably poorly soluble in ethyl acetate.

The definition of "poorly soluble in ethyl acetate" is that the light transmittance at a wavelength of 500 nm in an optical path length of 1 cm is less than 20% after a mixture of 100 parts by mass of ethyl acetate and 40 parts by mass of the colorant dispersed resin is left at 50° C. for 12 hours.

When the non-crystalline resin is used as the colorant dispersed resin, the non-crystalline resin is contained in the non-crystalline region.

The non-crystalline resin is not particularly limited, and examples thereof include non-crystalline polyesters, non-crystalline polyurethanes, non-crystalline polyureas, non-crystalline polyamides, non-crystalline polyethers, non-crystalline vinyl resins, non-crystalline urethane modified polyesters, non-crystalline urea modified polyesters, and non-crystalline polylactic acids. These may be used in combinations of two or more. Among these, non-crystalline polyesters are preferable.

The diol used in synthesis of the non-crystalline polyester is preferably linear or branched aliphatic diols.

The linear or branched aliphatic diols are not particularly limited. Examples thereof include ethylene glycol, 1,3-propanediol, 1,4-butanediol, 1,6-hexanediol, 1,9-nonanediol, 1,10-decanediol, 1,2-propylene glycol, butanediol, hexanediol, octanediol, decanediol, dodecanediol, tetradecanediol, neopentyl glycol, and 2,2-diethyl-1,3-propanediol.

When the block copolymer having a crystalline block and a non-crystalline block is used as the colorant dispersed resin, the crystalline block is contained in the crystalline region and the non-crystalline block is contained in the non-crystalline region.

Examples of the crystalline block include crystalline polyester blocks, crystalline polyurethane blocks, crystalline polyurea blocks, crystalline polyamide blocks, crystalline polyether blocks, crystalline vinyl resin blocks, crystalline urethane modified polyester blocks, and crystalline urea modified polyester blocks. These may be used in combinations of two or more. Among these, crystalline polyester blocks are preferable.

Examples of the non-crystalline block include non-crystalline polyester blocks, non-crystalline polyurethane blocks, non-crystalline polyurea blocks, non-crystalline polyamide blocks, non-crystalline polyether blocks, non-crystalline vinyl resin blocks, non-crystalline urethane modified polyester blocks, non-crystalline urea modified polyester blocks, and non-crystalline polylactic acid blocks. These may be used in combinations of two or more. Among these, non-crystalline polyester blocks are preferable.

The solubility of the colorant dispersed resin in ethyl acetate can be controlled by adjusting the molecular weight, the symmetry of the monomer skeleton, steric hindrance, and the like. By reducing the symmetry of the monomer skeleton or increasing steric hindrance, the solubility of the colorant dispersed resin in ethyl acetate can be improved.

The glass transition temperature of the colorant dispersed resin is usually, −20° C. to 70° C., and preferably 40° C. to 70° C. At a glass transition temperature of the non-crystalline resin less than −20° C., the heat-resistant storage properties of the toner may reduce. At a glass transition temperature more than 70° C., the low-temperature fixing properties of the toner may reduce.

The content of the colorant dispersed resin in the binder resin is usually 5% by mass to 50% by mass, preferably 10% by mass to 40% by mass, and more preferably 15% by mass to 30% by mass. At a content of the colorant dispersed resin in the binder resin less than 5% by mass, the sea island structure may be difficult to form. At a content more than 50% by mass, the low-temperature fixing properties of the toner may reduce.

<Colorant>

The colorant is not particularly limited as long as the colorant is a pigment or a dye. Examples thereof include carbon black, nigrosine dye, iron black, Naphthol Yellow S, Hansa Yellow (10G, 5G, G), cadmium yellow, yellow iron oxide, yellow ocher, chrome yellow, titanium yellow, polyazo yellow, oil yellow, Hansa Yellow (GR, A, RN, R), Pigment Yellow L, benzidine yellow (G, GR), Permanent yellow (NCG), Vulcan Fast Yellow (5G, R), tartrazine lake, quinoline yellow lake, Anthrazan Yellow BGL, isoindolinone yellow, red iron oxide, red lead oxide, lead vermilion, cadmium red, cadmium mercury red, antimony vermilion, Permanent Red 4R, para red, Fisay red, parachloro-orthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Lubin B, Brilliant Scarlet G, Lithol Lubin GX, Permanent Red F5R, Brilliant Carmine 6B, Pigment Scarlet 3B, Bordeaux 5B, toluidine maroon, Permanent Bordeaux F2K, Helio Bordeaux BL, Bordeaux 10B, bon maroon light, bon maroon medium, eosin lake, Rhodamine Lake B, Rhodamine Lake Y, alizarin lake, thioindigo red B, thioindigo maroon, oil red, quinacridone red, pyrazolone red, polyazo red, chrome vermilion, benzidine orange, Perinon Orange, oil orange, cobalt blue, Selulian blue, Alkali Blue Lake, Peacock Blue Lake, Victoria Blue Lake, non-metal Phthalocyanine Blue, Phthalocyanine Blue, Fast Sky Blue, Indanthrene Blue (RS, BC), indigo, ultramarine, Prussian blue, anthraquinone blue, Fast Violet B, methyl violet lake, cobalt violet, manganese violet, dioxane violet, anthraquinone violet, chromium green, zinc green, chromium oxide, Pylidian, Emerald Green, Pigment Green B, Naphthol Green B, green gold, acid green lake, malachite green lake, phthalocyanine green, anthraquinone green, titanium oxide, zinc oxide, and lithopone. These may be used in combinations of two or more.

The color of the colorant is not particularly limited, and examples thereof include black, magenta, cyan, and yellow. These may be used in combinations of two or more.

Examples of the colorant for black include carbon blacks (C.I. Pigment Black 7) such as furnace black, lamp black, acetylene black, and channel black; metals such as copper and iron (C.I. Pigment Black 11), and titanium oxide; and organic pigments such as aniline black (C.I. Pigment Black 1).

Examples of the colorant for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; and C.I. Vat Red 1, 2, 10, 13, 15, 23, 29, and 35.

Examples of the colorant for cyan include C.I. Pigment Blue 2, 3, 15, 15:1, 15:2, 15:3, 15:4, 15:6, 16, 17, and 60; C.I. Vat Blue 6; C.I. Acid Blue 45, copper phthalocyanine pigments having a phthalocyanine skeleton substituted by 1 to 5 phthalimidomethyl groups, Green 7, and Green 36.

Examples of the colorant for yellow include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 3, and 20, and Orange 36.

The content of the colorant in the toner is usually 1% by mass to 15% by mass, and preferably 3% by mass to 10% by mass. At a content of the colorant in the toner less than 1% by mass, the coloring ability of the toner may reduce. At a content more than 15% by mass, the coloring ability of the toner may reduce, or the electrical properties of the toner may reduce.

The colorant may form a composite of a non-crystalline resin or a block copolymer, and be used as a masterbatch.

The non-crystalline resin or block copolymer can be melt kneaded with the colorant according to the melt kneading method or the so-called method for producing a masterbatch. For the treatment method, all known methods for enabling mixing of the non-crystalline resin or block copolymer with the colorant by melt kneading can be used. For example, a heat kneader such as a continuous twin screw extruder (such as a KTK type twin screw extruder made by Kobe Steel, Ltd., a TEM type twin screw extruder made by TOSHIBA MACHINE CO., LTD., a PCM type twin screw extruder made by Ikegai Corp., and a KEX type twin screw extruder made by Kurimoto, Ltd.), a continuous single screw kneader (such as a Co-kneader made by Buss AG and a kneader made by KCK Corp.), a direct open roll mill type continuous kneader Kneadex (an open roll mill continuous kneading granulation machine, made by NIPPON COKE & ENGINEERING CO., LTD.) can be used.

For example, when a single screw kneader Cokneader made by Buss AG is used for melt kneading, desirably, the inlet temperature is controlled to be 50° C. to 120° C., the outlet temperature is controlled to be 40° C. to 70° C., and the screw temperature is controlled to be 30° C. to 40° C. Desirably, the screw number of rotation is 80 rpm, and the feed rate is 5 kg/h.

Alternatively, the masterbatch can be produced using a wet dispersing machine by dispersing the non-crystalline resin or block copolymer and the colorant in an organic solvent.

The wet dispersing machine is not particularly limited, and examples thereof include an Ultra Visco Mill (made by Aimex Co., Ltd.) that is a bead mill, a paint shaker (made by ASADA IRON WORKS. CO., LTD.), and a Nanomizer NM2-L200AR-D (made by YOSHIDA KIKAI CO., LTD.).

Further, the masterbatch can be produced using a high shear dispersing apparatus such as a three roll mill by applying a shear force and mixing and kneading the non-crystalline resin or block copolymer with the colorant. At this time, to enhance the interaction of the non-crystalline resin or block copolymer with the colorant, an organic solvent is preferably added. Moreover, the so-called flushing process is preferably used because a wet cake of the colorant can be used as it is, and does not need to be dried. The flushing process is a method in which an aqueous paste of the colorant and the non-crystalline resin or block copolymer are mixed and kneaded with an organic solvent to contain the colorant in the non-crystalline resin or block copolymer, and then water and the organic solvent are removed.

<Other Components>

The toner may further contain an organically modified layered inorganic mineral, a mold release agent, a charge control agent, a fluidity improver, a cleaning property improver, a magnetic material, and the like.

<<Organically Modified Inorganic Mineral>>

The organically modified layered inorganic mineral is a layered inorganic mineral in which at least part of ions existing between layers is substituted by an organic ion. At this time, the layered inorganic mineral is a layered inorganic mineral formed by layering layers each having a thickness of several nanometers. The term "modified" means that an organic ion is introduced into the ions existing between layers of the layered inorganic mineral. In a broad sense, the term means intercalation.

It was found that if the toner containing 50% by mass or more of the crystalline resin based on the binder resin contains the organically modified layered inorganic mineral in which at least part of the ions existing between layers of the layered inorganic mineral is modified with an organic ion, stress resistance equivalent to that given by the related art can be given, and scratches in an image conveyed caused during recrystallization immediately after thermal fixing and insufficient hardness of an output image can be eliminated, which are not attained by the related art.

The layered inorganic mineral exhibits the largest effect when the layered inorganic mineral is disposed in the vicinity of the surface layer of the toner. It is known that the organically modified layered inorganic mineral is uniformly arranged tightly in the vicinity of the surface layer of the toner. For this reason, the structure viscosity of the binder resin in the vicinity of the surface layer of the toner is increased efficiently. As a result, even in an image having low resin hardness as is seen immediately after fixing, the image is sufficiently protected. A small amount of such a layered inorganic mineral to be added allows the effect to be exhibited efficiently, and it is presumed that fixing properties are hardly inhibited.

Here, the state of the organically modified layered inorganic mineral in the toner can be checked by preparing a sample of toner particles contained in an epoxy resin or the like, machining the sample with a micromicrotome or ultramicrotome, and observing the cross section of the toner with a scanning electron microscope (SEM) or the like. In the case of observation with the SEM, check using a backscattered electron image is preferable because existence of the organically modified layered inorganic mineral can be observed in a high contrast. Alternatively, using an FIB-STEM (HD-2000, made by Hitachi, Ltd.), a sample of toner particles contained in an epoxy resin or the like may be machined with an ion beam, and the cross section of the toner may be observed. In this case, check using a backscattered electron image is also preferable because the image is easily visually observed.

The vicinity of the surface of the toner is defined as a region from the uppermost surface of the toner to 0 nm to 300 nm toward the inside of the toner in an image of the cross section of the toner to be observed, the toner being obtained by preparing a sample of toner particles contained in an epoxy resin or the like, and machining the sample with a micromicrotome, ultramicrotome, or FIB-STEM.

The layered inorganic mineral is not particularly limited, and examples thereof include smectite group clay minerals such as montmorillonite, saponite, and hectorite; kaolin group clay minerals such as kaolinite; and bentonite, attapulgite, magadiite, kanemite. These may be used in combinations of two or more. Among these, smectite group clay minerals are preferable, and montmorillonite is more preferable.

The organic ion is not particularly limited, and examples thereof include quaternary ammonium ions, phosphonium ions, and imidazolium ions; branched, non-branched, or cyclic alkyls having 1 to 44 carbon atoms; branched, non-branched, or cyclic alkenyls having 1 to 22 carbon atoms; branched, non-branched, or cyclic alkoxys having 8 to 32 carbon atoms; branched, non-branched, or cyclic hydroxyalkyls having 2 to 22 carbon atoms; and sulfuric acid ion, sulfonic acid ion, carboxylic acid ion, and phosphoric acid ion having a skeleton such as ethylene oxide and propylene oxide. These may be used in combinations of two or more. Among these, quaternary ammonium ions are preferable.

Examples of quaternary alkyl ammonium ions include trimethylstearylammonium ion, dimethylstearylbenzylammonium ion, dimethyloctadecylammonium ion, and oleylbis(2-hydroxyethyl)methylammonium ion.

In the organically modified layered inorganic mineral, at least part of the ions existing between layers of the layered inorganic mineral is modified with an organic ion. This can be checked by gas chromatograph mass spectrometry (GCMS). Suitable examples of the method for checking include a method in which the binder resin in the toner as a sample is dissolved in a solvent, and the obtained solution is filtered; the obtained solid product is pyrolyzed with a pyrolysis apparatus; by GCMS, the structure of the organic product is identified. Specifically, examples thereof include a method in which using a Py-2020D (made by Frontier Laboratories Ltd.) as a pyrolysis apparatus, pyrolysis is performed at 550° C., and identification is performed with a GCMS apparatus QP5000 (made by SHIMADZU Corporation).

The organically modified layered inorganic mineral may be an organically modified layered inorganic mineral in which at least part of divalent metal ions existing between layers is substituted by a trivalent metal ion to introduce an inorganic anion, and at least part of the inorganic anion is substituted by an organic anion.

Examples of commercially available products of the organically modified layered inorganic mineral include Quaternium 18 bentonite such as Bentone 3, Bentone 38, and Bentone 38V (all of which are made by Rheox, Inc.), TIXOGEL VP (made by United Catalyst, LLC), Kraton 34, Kraton 40, and Kraton XL (all of which are made by Southern Clay Products, Inc.); stearalkonium bentonite such as Bentone 27 (made by Rheox, Inc.), TIXOGEL LG (made by United Catalyst, LLC), and Kraton AF and Kraton APA (both of which are made by Southern Clay Products, Inc.); Quaternium 18/benzalkonium bentonite such as Kraton HT and Kraton PS (both of which are made by Southern Clay Products, Inc.); organically modified montmorillonite such as Kraton HY (made by Southern Clay Products, Inc.); and organically modified smectite such as Lucentite SPN (made by Co-op Chemical Co., Ltd.).

The organically modified layered inorganic mineral may be the one in which at least part of anions existing between layers of DHT-4A (made by Kyowa Chemical Industry Co., Ltd.) is substituted by an organic anion represented by the general formula:

$$R_1(OR_2)_nOSO_3^- \quad (A)$$

wherein $R_1$ is an alkyl group having 13 carbon atoms, $R_2$ is an alkylene group having 2 to 6 carbon atoms, and n is an integer of 2 to 10.

Examples of commercially available products of compounds having the organic anion represented by general formula (A) include Hitenol 330T (made by Dai-ichi Kogyo Seiyaku Co., Ltd.).

As in the case of the colorant, the organically modified layered inorganic mineral may form a composite with the block copolymer, crystalline polyester and/or non-crystalline polyester, and be used as a masterbatch.

The content of the organically modified layered inorganic mineral in the toner is usually 0.1% by mass to 3.0% by mass, preferably 0.5% by mass to 2.0% by mass, and more preferably 1.0% by mass to 1.5% by mass. At a content of the organically modified layered inorganic mineral in the toner less than 0.1% by mass, the stress resistance of the toner may reduce. At a content more than 3.0% by mass, the low-temperature fixing properties of the toner may reduce.

<<Mold Release Agent>>

The mold release agent is not particularly limited, and examples thereof include waxes having a carbonyl group, polyolefin waxes, and long-chain hydrocarbon waxes. These may be used in combinations of two or more. Among these, waxes having a carbonyl group are preferable.

Examples of the wax having a carbonyl group include carnauba wax, montan wax, polyalkanoic acid esters such as trimethylolpropane tribehenate, pentaerythritol tetrabehenate, pentaerythritoldiacetate dibehenate, glycerol tribehenate, and 1,18-octadecanediol distearate; polyalkanol esters such as tristearyl trimellitate and distearyl maleate; polyalkanoic acid amides such as dibehenylamide; polyalkyl amides such as trimellitic acid tristearyl amide; and dialkyl ketones such as distearyl ketone. Among these, polyalkanoic acid esters are preferable.

Examples of polyolefin wax include polyethylene wax and polypropylene wax.

Examples of long-chain hydrocarbon wax include paraffin wax and Sasolwax.

The melting point of the mold release agent is usually 40° C. to 160° C., preferably 50° C. to 120° C., and more preferably 60° C. to 90° C. At a melting point of the mold release agent less than 40° C., the heat-resistant storage properties of the toner may reduce. At a melting point more than 160° C., the cold offset resistance of the toner may reduce.

The melting point of the mold release agent can be measured using a differential scanning calorimeter DSC210 (made by Seiko Instruments Inc.). Specifically, the temperature of a sample is raised to 200° C., lowered at 10° C./min to 0° C., and then raised at 10° C./min.

The melt viscosity at a temperature 20° C. higher than the melting point of the mold release agent is usually 5 cps to 1,000 cps, and preferably 10 cps to 100 cps. If the melt viscosity at a temperature 20° C. higher than the melting point of the mold release agent is less than 5 cps, the releasing properties of the toner may reduce. If the melt viscosity is more than 1,000 cps, the hot offset resistance and low-temperature fixing properties of the toner may reduce.

The content of the mold release agent in the toner is usually 0% by mass to 40% by mass, and preferably 3% by mass to 30% by mass. At a content of the mold release agent in the toner more than 40% by mass, the fluidity of the toner may reduce.

<<Charge Control Agent>>

The charge control agent is not particularly limited, and examples thereof include triphenylmethane dyes, molybdic acid chelate pigments, rhodamine dyes, alkoxy amines, quaternary ammonium salts (including fluorine modified quaternary ammonium salts), alkyl amides, a single substance of phosphorus or a compound thereof, a single substance of tungsten or a compound thereof, fluorine-containing surfactants, metal salts of salicylic acid, metal salts of salicylic acid derivatives, quinacridone, azo pigments, high-molecular compounds having a sulfonic acid group, high-molecular compounds having a carboxyl group, and high-molecular compounds having a quaternary ammonium salt group. These may be used in combinations of two or more.

Examples of commercially available products of the charge control agent include a quaternary ammonium salt BONTRON P-51, an oxynaphthoic acid metal complex E-82, a salicylic acid metal complex E-84, and a phenol condensate E-89 (all of which are made by ORIENT CHEMICAL INDUSTRIES CO., LTD.), quaternary ammonium salt molybdenum complexes TP-302 and TP-415 (both of which are made by HODOGAYA CHEMICAL CO., LTD.), a quaternary ammonium salt Copy Charge PSY VP2038, a triphenylmethane derivative Copy Blue PR, and quaternary ammonium salts Copy Charge NEG VP2036 and Copy Charge NX VP434 (all of which are made by Hoechst AG); and LRA-901, a boron complex LR-147 (made by Japan Carlit Co., Ltd.).

The charge control agent may be melt kneaded with the binder resin, and then dissolved or dispersed in an organic solvent described later, or may be added to the organic solvent described later when the charge control agent is dissolved or dispersed therein.

The mass ratio of the charge control agent based on the binder resin is usually, 0.1% by mass to 10% by mass, and preferably 0.2% by mass to 5% by mass. If the mass ratio of the charge control agent based on the binder resin is less than 0.1% by mass, the charging properties of the toner may reduce. If the mass ratio is more than 10% by mass, the fluidity of the toner may reduce, or image density may reduce.

<<External Additive>>

The external additive is not particularly limited, and examples thereof include silica fine particles, hydrophobized silica fine particles, fatty acid metal salts (such as zinc stearate and aluminum stearate); metal oxides (such as titanium oxide, alumina, tin oxide, and antimony oxide), hydrophobized metal oxide particles, and fluorinated resin particles. These may be used in combinations of two or more. Among these, hydrophobized silica particles, hydrophobized titanium oxide particles, and hydrophobized alumina particles are preferable.

Examples of commercially available products of silica particles include HDK H 2000, HDK H 2000/4, HDK H 2050EP, HVK21, and HDK H1303 (all of which are made by Hoechst AG); R972, R974, RX200, RY200, R202, R805, and R812 (all of which are made by Nippon Aerosil Co., Ltd.).

Examples of commercially available products of titanium oxide particles include P-25 (made by Nippon Aerosil Co., Ltd.), STT-30 and STT-65C-S (both of which are made by Titan Kogyo, Ltd.), TAF-140 (made by Fuji Titanium Industry Co., Ltd.), and MT-150W, MT-500B, MT-600B, and MT-150A (all of which are made by Tayca Corporation).

Examples of commercially available products of hydrophobized titanium oxide particles include T-805 (made by Nippon Aerosil Co., Ltd.); STT-30A and STT-65S-S (both of which are made by Titan Kogyo, Ltd.); TAF-500T and TAF-1500T (both of which are made by Fuji Titanium Industry Co., Ltd.); MT-100S and MT-100T (both of which are made by Tayca Corporation), and IT-S (made by Ishihara Sangyo Kaisha, Ltd.).

The method for producing a hydrophobized metal oxide particle is not particularly limited, and examples thereof include a method for treating a metal oxide particle with a silane coupling agent, and a method for treating a metal oxide particle with silicone oil.

The silane coupling agent is not particularly limited, and examples thereof include methyltrimethoxysilane, methyltriethoxysilane, and octyltrimethoxysilane.

The silicone oil is not particularly limited, and examples thereof include dimethyl silicone oil, methylphenyl silicone oil, chlorophenyl silicone oil, methyl hydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acrylic modified silicone oil, methacrylic modified silicone oil, and α-methylstyrene modified silicone oil.

Examples of the inorganic fine particles can include silica, alumina, titanium oxide, barium titanate, magnesium titanate, calcium titanate, strontium titanate, iron oxide, copper oxide, zinc oxide, tin oxide, quartz sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride. Among these, silica and titanium dioxide are particularly preferable.

The content of the external additive in the toner is usually 0.1% by mass to 5% by mass, and preferably 0.3% by mass to 3% by mass.

The average primary particle size of the metal oxide particle is usually 1 nm to 100 nm, and preferably 5 nm to 70 nm. At an average primary particle size of the metal oxide particle less than 1 nm, the fluidity improver may be buried in the toner. At an average primary particle size more than 100 nm, the surface of a photoconductor may be scratched.

Preferably, the external additive contains two or more hydrophobized metal oxide particles having an average primary particle size of 20 nm or less, and one or more metal oxide particles having an average primary particle size of 30 nm or more.

The BET specific surface area of the metal oxide particle is usually 20 $m^2/g$ to 500 $m^2/g$.

Examples of a surface treatment agent for the external additive containing the oxide fine particle include silane coupling agents such as dialkyl dihalogenated silane, trialkyl halogenated silane, alkyl trihalogenated silane, and hexaalkyldisilazane; silylating agents, silane coupling agents having a fluorinated alkyl group, organic titanate coupling agents, aluminum coupling agents, silicone oil, and silicone varnish.

A resin fine particle can also be added as the external additive. Examples of the resin fine particle include polystyrenes obtained by soap-free emulsion polymerization, suspension polymerization, and dispersion polymerization; copolymers of methacrylic acid esters and acrylic acid esters; polycondensation polymer particles of silicone, benzoguanamine, nylon, and the like; and polymer particles of thermosetting resins. Use of such a resin fine particle in combination can enhance the charging properties of the toner, decrease the reverse charged toner, and reduce background dirt. The amount of the resin fine particle to be added is preferably 0.01% by mass to 5% by mass, and more preferably 0.1% by mass to 2% by mass based on the toner.

<<Fluidity Improver>>

The fluidity improver means an agent that surface treats the toner to increase hydrophobicity, and can prevent degradation of the rheological properties and charging properties of the toner even under a high humidity. Examples thereof include silane coupling agents, silylating agents, silane coupling agents having a fluorinated alkyl group, organic titanate coupling agents, aluminum coupling agents, silicone oil, and modified silicone oil.

<<Cleaning Property Improver>>

The cleaning property improver is added to the toner to remove an electrostatic latent image carrier or a developer remaining on an intermediate transfer member after transfer. Examples thereof include fatty acid metal salts such as zinc stearate, calcium stearate, and stearic acid; and polymer fine particles produced by soap-free emulsion polymerization such as polymethyl methacrylate fine particles and polystyrene fine particles. The polymer fine particle preferably has relatively narrow particle size distribution. The weight average particle size is suitably 0.01 μm to 1 μm.

The cleaning property improver is not particularly limited, and examples thereof include metal salts of fatty acids such as zinc stearate and calcium stearate; and resin particles such as polymethyl methacrylate particles and polystyrene particles. The weight average particle size of the cleaning property improver is usually 0.01 μm to 1 μm.

The content of the cleaning property improver in the toner is usually 0.01% by mass to 5% by mass, and preferably 0.1% by mass to 2% by mass.

<<Magnetic Material>>

The magnetic material is not particularly limited, and examples thereof include iron, magnetite, and ferrite.

[Properties of Toner]

The degree of crystallization of the toner is usually 12% or more, and preferably 15% or more. At a degree of crystallization of the toner less than 12%, the toner may not have low-temperature fixing properties and heat-resistant storage properties at the same time.

Wherein a shoulder temperature of the heat of fusion peak in the first temperature raising operation by a differential scanning calorimeter is $T_{sh\ 1st}$ [° C.], and that in the second temperature raising operation by a differential scanning calorimeter is $T_{sh\ 2nd}$ [° C.], the toner preferably satisfy the expression: $0.90 \leq T_{sh\ 2nd}/T_{sh\ 1st} \leq 1.10$.

$T_{sh\ 1st}$ and $T_{sh\ 2nd}$ can be measured using a differential scanning calorimeter TA-60WS and DSC-60 (made by SHIMADZU Corporation).

The storage elastic modulus at 160° C. of the toner is usually $1.0\times10^3$ Pa to $1.6\times10^4$ Pa, and preferably $5.0\times10^3$ Pa to $1.0\times10^4$ Pa.

The storage elastic modulus at 160° C. of the toner can be measured using a dynamic rheometer.

The melting point of the toner is usually 45° C. to 70° C., preferably 53° C. to 65° C., and more preferably 58° C. to 62° C. At a melting point of the toner less than 45° C., the heat-resistant storage properties of the toner may reduce. At a melting point more than 70° C., the low-temperature fixing properties of the toner may reduce.

The ratio of the softening temperature to the melting point of the toner is usually 0.80 to 1.55, preferably 0.85 to 1.25, and more preferably 0.9 to 1.20, and particularly preferably 0.90 to 1.19. At a ratio of the softening temperature to the melting point of the toner less than 0.80, the hot offset resistance of the toner may reduce. At a ratio of more than 1.60, it may be difficult for the toner to have low-temperature fixing properties and heat-resistant storage properties at the same time.

The storage elastic modulus G' at a temperature 20° C. higher than the melting point of the toner is usually $1.0\times10^3$ Pa·s to $5.0\times10^6$ Pa·s, and preferably $1.0\times10^4$ Pa·s to $5.0\times10^5$ Pa·s.

The loss elastic modulus G" at a temperature 20° C. higher than the melting point of the toner is usually $1.0\times10^3$ Pa·s to $5.0\times10^6$ Pa·s, and preferably $1.0\times10^4$ Pa·s to $5.0\times10^5$ Pa·s.

The ratio of the loss elastic modulus G" at a temperature 30° C. higher than the melting point of the toner to the loss elastic modulus G" at a temperature 70° C. higher than the melting point of the toner is usually 0.05 to 50, and preferably 0.1 to 40, and more preferably 0.5 to 30.

The viscoelasticity of the toner can be controlled by adjusting the ratio of the crystalline resin to the non-crystalline resin that form the binder resin, the molecular weight of the resin, the composition of the monomer, and the like.

[Method for Producing Toner]

In production of the toner, a chemical method in which granulation is performed in an aqueous medium can be used. Use of the chemical method can easily granulate the crystalline resin, and easily dispose the organically modified layered inorganic mineral in the vicinity of the surface of the toner.

The chemical method in which granulation is performed in an aqueous medium is not particularly limited. Examples thereof include a suspension polymerization method, emulsion polymerization method, seed polymerization method, and dispersion polymerization method in which a monomer is used as a starting raw material and production is performed; a dissolution suspension method in which a composition containing a resin (such as a crystalline resin and a non-crystalline resin or block copolymer) and a colorant is dissolved or dispersed in an organic solvent to prepare a solution, and the solution is emulsified or dispersed in an aqueous medium; a phase inversion emulsification method in which a composition containing a resin, a precursor, a colorant, and an emulsifier is dissolved or dispersed in an organic solvent to prepare a solution, and water is added to the solution for phase inversion; and an aggregation method in which the particle obtained by these methods is dispersed in an aqueous medium, and in this state, the particle is aggregated by heat melting or the like. Among these, the dissolution suspension method is preferable from the viewpoint of controlling the particle size distribution and the shape of the particle.

The method for producing a toner preferably has a step of dissolving or dispersing a toner composition containing a crystalline resin and a non-crystalline resin or a block copolymer having a crystalline block and a non-crystalline block, and a colorant in an organic solvent to prepare a first solution, a step of dispersing or emulsifying the first solution in an aqueous medium to prepare a second solution, and a step of removing the organic solvent from the second solution. More preferably, in the first step, a crystalline precursor having a functional group capable of reacting with an active hydrogen group (reactive group-containing prepolymer) is added, and an active hydrogen group-containing compound contained in the oil phase composition and/or in an aqueous medium is reacted with the reactive group-containing prepolymer. By this method, the mother particle of the toner is granulated and obtained.

The method for producing a resin fine particle is not particularly limited, and can be properly selected according to the purpose. Examples of the method include the following (a) to (h):

(a) A method in the case of a vinyl resin in which using a monomer as a starting raw material, an aqueous dispersion liquid of a resin fine particle is directly produced by a polymerization reaction such as a suspension polymerization method, an emulsion polymerization method, a seed polymerization method, and a dispersion polymerization method.

(b) A method in the case of a polyaddition or condensation resin such as a polyester resin, a polyurethane resin, and an epoxy resin in which a precursor (such as a monomer and an oligomer) or a solvent solution thereof is dispersed in a water-based medium in the presence of a proper dispersant, and the obtained solution is heated or a curing agent is added to the solution to cure the solution; thereby, an aqueous dispersion of a resin fine particle is produced.

(c) A method in the case of a polyaddition or condensation resin such as a polyester resin, a polyurethane resin, and an epoxy resin in which a proper emulsifier is dissolved in a precursor (such as a monomer and an oligomer) or a solvent solution thereof (which is preferably a liquid, or may be a one liquefied by heating), and water is added to perform phase inversion emulsion.

(d) A method in which a resin produced in advance by a polymerization reaction (which may be any polymerization reaction method of addition polymerization, ring-opening polymerization, polyaddition, addition condensation, condensation polymerization, and the like) is crushed by a micro mill such as a mechanical rotary type micro mill and a jet type micro mill, and classified to obtain a resin fine particle; then, the particle is dispersed in water in the presence of a proper dispersant.

(e) A method in which a resin produced in advance by a polymerization reaction (which may be any polymerization reaction method of addition polymerization, ring-opening polymerization, polyaddition, addition condensation, condensation polymerization, and the like) is dissolved in a solvent to prepare a resin solution, and the resin solution is sprayed in a mist form to obtain a resin fine particle; then, the particle is dispersed in water in the presence of a proper dispersant.

(f) A method in which a resin produced in advance by a polymerization reaction (which may be any polymerization reaction method of addition polymerization, ring-opening polymerization, polyaddition, addition condensation, condensation polymerization, and the like) is dissolved in a solvent to prepare a resin solution, and a solvent is added to the resin solution, or the resin is heat dissolved in the solvent in advance to prepare a resin solution, and the resin solution is cooled to deposit a resin fine particle; next, the solvent is removed to obtain a resin fine particle; then, the particle is dispersed in water in the presence of a proper dispersant.

(g) A method in which a resin produced in advance by a polymerization reaction (which may be any polymerization reaction method of addition polymerization, ring-opening polymerization, polyaddition, addition condensation, condensation polymerization, and the like) is dissolved in a solvent to prepare a resin solution; the resin solution is dispersed in a water-based medium in the presence of a proper dispersant; the solvent is removed by heating the obtained solution, reducing pressure, or the like.

(h) A method in which a resin produced in advance by a polymerization reaction (which may be any polymerization reaction method of addition polymerization, ring-opening polymerization, polyaddition, addition condensation, condensation polymerization, and the like) is dissolved in a solvent to prepare a resin solution; a proper emulsifier is dissolved in the resin solution, and water is added to perform phase inversion emulsion.

—Organic Solvent—

The organic solvent is not particularly limited, and examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used in combinations of two or more. Among these, esters such as methyl acetate and ethyl acetate; aromatics such as toluene and xylene; and halogenated hydrocarbons such as methylene chloride, 1,2-dichloroethane, chloroform, and carbon tetrachloride are preferable.

The organic solvent preferably has a boiling point of 100° C. or less. At a boiling point of the organic solvent more than 100° C., the organic solvent may be difficult to remove.

The concentration of the solid content in the first solution is usually 40% by mass to 80% by mass. At a concentration of the solid content in the first solution less than 40% by mass, the amount of the toner to be produced may be decreased. At a concentration more than 80% by mass, the toner composition may be difficult to dissolve or disperse in the organic solvent, or viscosity may increase.

In preparation of the first solution, components contained in the toner composition or the masterbatch thereof may be dissolved or dispersed in the organic solvent, and mixed.

—Aqueous Medium—

Examples of the aqueous medium include water, or a mixed solvent of water and a solvent miscible with water.

The solvent miscible with water is not particularly limited, and examples thereof include alcohols such as methanol, isopropanol, and ethylene glycol; cellosolves such as methyl cellosolve; ketones such as acetone and methyl ethyl ketone; and dimethylformamide, and tetrahydrofuran.

The mass ratio of the aqueous medium to the toner composition is usually 0.50 to 20, and preferably 1 to 10. At a mass ratio of the aqueous medium to the toner composition less than 0.50, the dispersibility of the toner composition may reduce. At a mass ratio of more than 20, it is not economical.

Preferably, an inorganic dispersant or a resin fine particle may be dispersed in the aqueous medium in advance, resulting in a sharp particle size distribution and good dispersion stability.

The inorganic dispersant is not particularly limited, and examples thereof include tricalcium phosphate, calcium carbonate, titanium oxide, colloidal silica, and hydroxyapatite.

The resin that forms the resin fine particle is not particularly limited as long as the resin can be dispersed in the aqueous medium. Examples of the resin include vinyl resins, polyurethanes, epoxy resins, polyesters, polyamides, polyimides, silicon resins, phenol resins, melamine resins, urea resins, aniline resins, ionomer resins, and polycarbonates. These may be used in combinations of two or more. Among these, vinyl resins, polyurethanes, epoxy resins, and polyesters are preferable.

—Surfactant—

The surfactant is not particularly limited, and examples thereof include anionic surfactants such as alkylbenzene sulfonic acid salts, α-olefin sulfonic acid salts, and phosphoric acid esters; amine salt cationic surfactants such as alkylamine salts, aminoalcohol fatty acid derivatives, polyamine fatty acid derivatives, and imidazoline; alkyltrimethyl ammonium salts, dialkyl dimethyl ammonium salts, quaternary ammonium salt cationic surfactants such as alkyldimethylbenzyl ammonium salts, pyridinium salts, alkyl isoquinolinium salts, and benzethonium chloride; nonionic surfactants such as derivatives of fatty acid amides and derivatives of polyhydric alcohols; and amphoteric surfactants such as alanine, dodecylbis(aminoethyl)glycine, bis(octyl aminoethyl)glycine, and N-alkyl-N,N-dimethylammonium betaine. Among these, surfactants having a fluoroalkyl group are preferable.

Examples of the surfactants having a fluoroalkyl group include anionic surfactants having a fluoroalkyl group and cationic surfactants having a fluoroalkyl group.

Examples of the anionic surfactants having a fluoroalkyl group include fluoroalkyl carboxylic acids having 2 to 10 carbon atoms and metal salts thereof, disodium perfluorooctanesulfonylglutamate, sodium 3-[ω-fluoroalkyl(C6 to C11)oxy]-1-alkyl(C3 to C4)sulfonate, sodium 3-[ω-fluoroalkanoyl(C6 to C8)-N-ethylamino]-1-propanesulfonate, fluoroalkyl(C11 to C20)carboxylic acids and metal salts thereof, perfluoroalkylcarboxylic acids (C7 to C13) and metal salts thereof, perfluoroalkyl(C4 to C12)sulfonic acid and metal salts thereof, perfluorooctanesulfonic acid diethanolamide, N-propyl-N-(2-hydroxyethyl)perfluorooctanesulfoneamide, perfluoroalkyl(C6 to C10)sulfonamide propyltrimethylammonium salts, perfluoroalkyl(C6 to C10)-N-ethylsulfonylglycine salts, and monoperfluoroalkyl(C6 to C16)ethylphosphoric acid esters.

Examples of the cationic surfactants having a fluoroalkyl group include aliphatic primary or secondary amine acids having a fluoroalkyl group, aliphatic quaternary ammonium salts such as perfluoroalkyl(C6 to C10)sulfonamide propyltrimethylammonium salts, benzalkonium salts, benzethonium chloride, pyridinium salts, and imidazolinium salts.

—Polymer Protecting Colloid—

The polymer-based protecting colloid is not particularly limited, and examples thereof include carboxylic acids such as acrylic acid, methacrylic acid, α-cyanoacrylic acid, α-cyanomethacrylic acid, itaconic acid, crotonic acid, fumaric acid, maleic acid, and maleic anhydride; (meth) acrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerol monoacrylic acid ester, glycerol monomethacrylic acid ester, N-methylolacrylamide, and N-methylolmethacrylamide; ethers with vinyl alcohols such as vinyl methyl ether, vinyl ethyl ether, and vinyl propyl ether; esters of vinyl alcohols and carboxylic acids such as vinyl acetate, vinyl propionate, and vinyl butyrate; amides and methylol compounds of amides such as acrylamide, methacrylamide, and diacetone acrylamide; acid chlorides such as chloride acrylate and chloride methacrylate; homopolymers or copolymers of compounds having a nitrogen atom or a nitrogen-containing heterocyclic ring such as vinylpyridine, vinylpyrrolidone, vinylimidazole, and ethyleneimine; polyoxyethylenes such as polyoxyethylene, polyoxypropylene, polyoxyethylenealkylamine, polyoxypropylenealkylamine, polyoxyethylenealkylamide, polyoxypropylenealkylamide, polyoxyethylene nonyl phenyl ether, polyoxyethylene lauryl phenyl ether, polyoxyethylene stearyl phenyl ester, polyoxyethylene nonyl phenyl ester; and celluloses such as methyl cellulose, hydroxyethyl cellulose, and hydroxypropyl cellulose.

—Dispersion Method—

The dispersing machine used in emulsification or dispersion of the first solution in the aqueous medium is not particularly limited, and examples thereof include a low speed shear dispersing machine, a high speed shear dispersing machine, a friction dispersing machine, a high pressure jet dispersing machine, and an ultrasonic dispersing machine. Among these, the high speed shear dispersing machine is preferable.

When the high speed shear dispersing machine is used, the number of rotation is usually 1,000 rpm to 30,000 rpm, and preferably 5,000 rpm to 20,000 rpm.

The temperature in emulsification or dispersion of the first solution in the aqueous medium is usually 0° C. to 150° C. (under increased pressure), and preferably 20° C. to 80° C.

In the case where in the production process of the toner, a crystalline prepolymer having a group capable of reacting with an active hydrogen group in the terminal is reacted with a compound having an active hydrogen group to synthesize a modified crystalline resin, the compound having an active hydrogen group may be contained in the toner composition, or may be mixed in the aqueous medium when the first solution is emulsified or dispersed in the aqueous medium.

The method for removing ethyl acetate from the second solution is not particularly limited, and examples thereof include a method for gradually raising the temperature of the entire system under normal pressure or reduced pressure, and a method for spraying the second solution in a mist form.

The mother particle can be produced by removing the organic solvent from the second solution. Preferably, the mother particle is washed, and dried.

In washing the mother particle, solid liquid separation is performed using a centrifuge, a filter press, or the like, the solid content is dispersed again in water at normal temperature to approximately 40° C., and when necessary the pH is adjusted with an acid or a base. Then, solid liquid separation is performed again. This operation is preferably repeated several times. Thereby, impurities, the surfactant, and the like can be removed.

At this time, the fine particle component of the mother particle may be removed by centrifugation or the like, or the mother particle may be dried, and when necessary, classified using a known classifier.

The dryer used in drying the mother particle is not particularly limited, and examples thereof include an air stream dryer, a circulation dryer, a reduced pressure dryer, and a vibrating fluid bed dryer.

The mother particle may be mixed with a different particle such as a charge control agent and a fluidity improver. At this time, a mechanical impact may be applied when necessary. Thereby, the different particle can be fixed onto the surface of the mother particle.

The method for applying a mechanical impact is not particularly limited, and examples thereof include a method for applying an impact to the particle by a blade that rotates a high speed, and a method for charging the particles into a high-speed air stream, and accelerating the speed to collide the particles each other or collide composite particles against a plate for collision.

The apparatus that applies a mechanical impact is not particularly limited, and examples thereof include an Angmill (made by Hosokawa Micron Corporation), a modified I type mill (made by Nippon Pneumatic Mfg. Co., Ltd.) in which the pressure of the crushing air is reduced, a hybridization system (made by Nara Machinery Co., Ltd.), a KRYPTRON system (made by Kawasaki Heavy Industries, Ltd.), and an automortar.

(Developer)

Next, a developer according to one embodiment of the present invention will be described.

The developer contains the toner according to the embodiment, and may further contain a carrier.

The carrier preferably has a core material whose surface is coated with a coating layer.

The material that forms the core material is not particularly limited, and examples thereof include iron powders having a mass magnetic susceptibility of 100 emu/g or more, highly magnetized materials having a mass magnetic susceptibility of 75 emu/g to 120 emu/g such as magnetite, weakly magnetized materials having a mass magnetic susceptibility of 30 emu/g to 80 emu/g such as copper-zinc (Cu—Zn) materials, manganese-strontium (Mn—Sr) materials having a mass magnetic susceptibility of 50 emu/g to 90 emu/g, and manganese-magnesium (Mn—Mg) materials. These may be used in combinations of two or more.

The weight average particle size (D50) of the core material is usually, 10 μm to 200 μm, and preferably 40 μm to 100 μm. At a weight average particle size (D50) of the core material less than 10 μm, the carrier may scatter. At a weight average particle size (D50) more than 200 μm, the toner may scatter.

The coating layer contains a resin.

The resin is not particularly limited, and examples thereof include amino resins, vinyl resins, polystyrene, halogenated olefin resins, polyester, polycarbonate, polyethylene, polyvinyl fluoride, polyvinylidene fluoride, polytrifluoroethylene, polyhexafluoropropylene, copolymers of vinylidene fluoride and an acrylic monomer, copolymers of vinylidene fluoride and vinyl fluoride, fluoro terpolymers such as terpolymer of tetrafluoroethylene, vinylidene fluoride, and a non-fluorinated monomer, and silicone resins. These may be used in combinations of two or more. Among these, silicone resins are preferable.

Examples of the silicone resins include straight silicone resins; and modified silicone resin modified with an alkyd resin, polyester, an epoxy resin, an acrylic resin, a urethane resin, and the like.

Examples of commercially available products of the straight silicone resins include KR271, KR255, and KR152 (all of which are made by Shin-Etsu Chemical Co., Ltd.); and SR2400, SR2406, and SR2410 (all of which are made by Dow Corning Toray Silicone Co., Ltd.).

Examples of commercially available products of the modified silicone resins include KR206 (alkyd modified), KR5208 (acrylic modified), ES1001N (epoxy modified), and KR305 (urethane modified) (all of which are made by Shin-Etsu Chemical Co., Ltd.); and SR2115 (epoxy modified) and SR2110 (alkyd modified) (both of which are made by Dow Corning Toray Silicone Co., Ltd.).

The coating layer may further contain a conductive particle.

The conductive particle is not particularly limited, and examples thereof include metal particles, carbon black, titanium oxide particles, tin oxide particles, and zinc oxide particles. Among these, carbon black is preferable.

The average particle size of the conductive particle is usually 1 μm or less. At an average particle size of the conductive particle more than 1 μm, the electric resistance of the coating layer may be difficult to control.

The coating layer can be formed by applying a coating solution for a coating layer containing a resin and an organic solvent onto the surface of the core material, drying the coating solution, and baking the dried coating solution.

The organic solvent is not particularly limited, and examples thereof include toluene, xylene, methyl ethyl ketone, methyl isobutyl ketone, cellosolve, and butyl acetate.

The method for applying a coating solution for a coating layer is not particularly limited, and examples thereof include a dipping method, a spray method, and a brush coating method.

A heating apparatus used for baking may be an external heating type or an internal heating type.

The heating apparatus is not particularly limited, and examples thereof include a fixed electric furnace, a fluid bed electric furnace, a rotary electric furnace, a burner furnace, and a microwave heating apparatus.

The content of the coating layer in the carrier is usually 0.01% by mass to 5.0% by mass.

The mass ratio of the toner to the carrier is usually 1% by mass to 10% by mass.

(Image Forming Apparatus)

Next, an image forming apparatus according to one embodiment of the present invention will be described.

The image forming apparatus includes a photoconductor, a charging apparatus, an exposure apparatus, a developing apparatus, a transfer apparatus, and a fixing apparatus, and may further include a cleaning apparatus, a static eliminator, a recycle apparatus, and the like when necessary.

The shape of the photoconductor is not particularly limited, and examples thereof include a drum shape, a sheet-like shape, and an endless belt-like shape.

The photoconductor may have a single layer structure, or have a layered structure.

The material that forms the photoconductor is not particularly limited, and examples thereof include inorganic substances such as amorphous silicon, selenium, cadmium sulfide, and zinc oxide; and organic substances such as polysilane and phthalopolymethine.

The charging apparatus is not particularly limited as long as the charging apparatus can uniformly charge the photoconductor by applying voltage to the surface of the photoconductor. Examples of the charging apparatus include a contact type charging apparatus that contacts the photoconductor to charge the photoconductor and a non-contact type charging apparatus that charge the photoconductor without contacting the photoconductor.

Examples of the contact type charging apparatus include conductive or semi-conductive charging rollers, magnetic brushes, fur brushes, films, and rubber blades.

Examples of the non-contact type charging apparatus include non-contact chargers using corona discharge, probe electrode devices, and solid discharging elements; and conductive or semi-conductive charging rollers disposed with a fine gap interposed between the photoconductor and the roller.

The exposure apparatus is not particularly limited as long as the surface of the photoconductor can be exposed as an image. Examples of the exposure apparatus include exposure units of copy optical types, rod lens array types, laser optical types, liquid crystal shutter optical types, and LED optical types.

The exposure apparatus may be a back exposure type that exposes the photoconductor from the rear surface thereof as an image.

The developing apparatus is not particularly limited as long as the developing apparatus can develop an electrostatic latent image formed on the surface of the photoconductor, using the developer according to the embodiment. Examples of the developing apparatus include developing apparatuses that can accommodate the developer and feed the developer to the electrostatic latent image in a contact or non-contact manner.

The developing apparatus may be a developing apparatus for a single color, or may be a developing apparatus for multi colors.

The developing apparatus preferably includes a stirrer that friction stirs the developer to charge the developer, and a magnet roller that can carry the developer on the surface thereof and rotate.

In the developing apparatus, the toner is charged by friction when the developer is mixed and stirred. Then, the developer is kept napped on the surface of the rotating magnet roller to form a magnetic brush. The magnet roller is disposed in the vicinity of the photoconductor. For this reason, part of the toner that forms the magnetic brush formed on the surface of the magnet roller moves to the surface of the photoconductor by an electrical attractive force. As a result, the electrostatic latent image is developed by the toner to form a toner image on the surface of the photoconductor.

Figure 2:
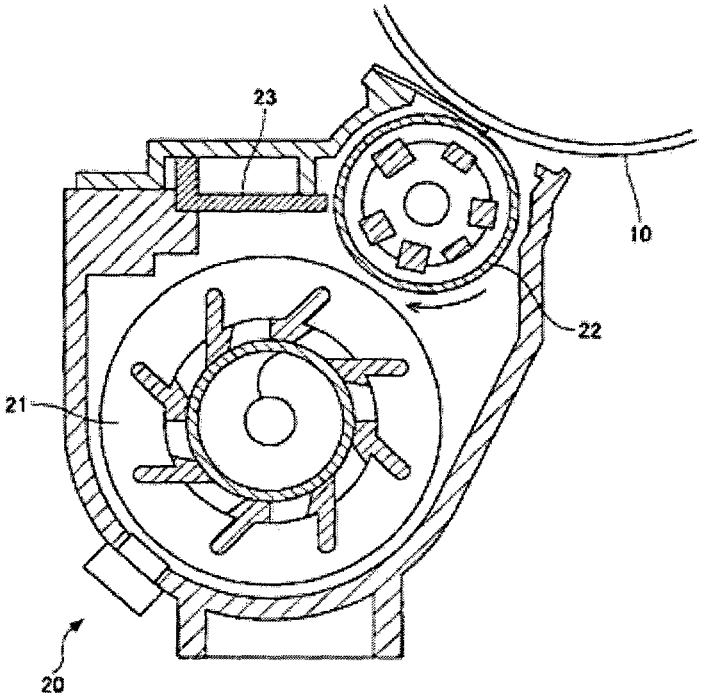
FIG. 2 is a schematic view showing one embodiment of a developing apparatus used in the present invention.

FIG. 2 is a diagram showing a developing apparatus according to one embodiment used in the present invention.

In a developing apparatus 20, the developer (not shown) is stirred by a screw 21, conveyed, and fed to a developing sleeve 22. At this time, the layer thickness of the developer fed to the developing sleeve 22 is regulated by a doctor blade 23. Namely, the amount of the developer to be fed to the developing sleeve 22 is controlled by a doctor gap that is an interval between the developing sleeve 22 and the doctor blade 23. An excessively small doctor gap leads to an excessively small amount of the developer to be fed to the developing sleeve 22, reducing the image density. Meanwhile, an excessively large doctor gap leads to an excessively large amount of the developer to be fed to the developing sleeve 22, causing the carrier to adhere to a drum-like photoconductor 10. Here, the inside of the developing sleeve 22 includes a magnet for forming a magnetic field (not shown) to keep the developer napped on the peripheral surface. Thereby, the developer is kept napped in a chain form on the developing sleeve 22 so as to align along a magnetic field line formed in the normal direction by the magnet. Thus, the magnetic brush is formed.

The developing sleeve 22 is disposed close to the photoconductor 10 with a constant interval (developing gap) interposed therebetween, and a region to be developed is formed in a portion in which the developing sleeve 22 faces the photoconductor 10. The developing sleeve 22 is a cylinder formed of a non-magnetic substance such as aluminum, brass, stainless steel, and a conductive resin, and can be rotated by a rotation drive mechanism (not shown). The magnetic brush is transported to the region to be developed by rotation of the developing sleeve 22. A developing voltage is applied to the developing sleeve 22 from a power supply for development (not shown). The toner on the magnetic brush is separated from the carrier by the development field formed between the developing sleeve 22 and the photoconductor 10. Then, the toner is developed on the electrostatic latent image formed on the surface of the photoconductor 10. An alternating voltage may be superimposed on the developing voltage.

The developing gap is preferably approximately 5 times to 30 times the particle size of the developer. An excessively large developing gap may reduce the image density.

Meanwhile, the doctor gap is preferably approximately equal to the developing gap or slightly larger than the developing gap.

The ratio of the linear velocity of the developing sleeve 22 to the linear velocity of the photoconductor 10 is preferably 1.1 or more. If the ratio of the linear velocity of the developing sleeve 22 to the linear velocity of the photoconductor 10 is excessively small, the image density may reduce.

The process condition can be controlled by providing a sensor at a position after development in the photoconductor 10 and detecting an amount of the adhering toner from optical reflectance.

Examples of the transfer apparatus include a transfer apparatus that directly transfers the toner image formed on the surface of the photoconductor onto a recording medium, and a transfer apparatus that primarily transfers the toner image formed on the surface of the photoconductor onto an intermediate transfer member, and secondarily transfers the primarily transferred image onto a recording medium.

The fixing apparatus is not particularly limited as long as the toner image transferred onto the recording medium can be fixed. Examples of the fixing apparatus include a fixing apparatus including a fixing member and a heat source for heating the fixing member.

The fixing member is not particularly limited as long as the fixing members can contact each other to form a nip portion. Examples of the fixing member include a combination of an endless belt and a roller and a combination of a roller and a roller.

Examples of the fixing apparatus include an internal heating type fixing apparatus having a roller and/or a belt, and heating the toner image transferred onto the recording medium from the side of the surface not contacting the toner image and fixing the toner image and applying pressure thereto; and an external heating type fixing apparatus having a roller and/or a belt, and heating the toner image transferred onto the recording medium from the side of the surface contacting the toner image and fixing the toner image and applying pressure thereto.

The internal heating may be combined with the external heating.

Examples of the internal heating type fixing apparatus include those including a fixing member having a heat source inside of the fixing member.

The heat source is not particularly limited, and examples thereof include a heater and a halogen lamp.

Examples of the external heating type fixing apparatus include those in which the surface of the fixing member is heated by a heating apparatus.

The heating apparatus is not particularly limited, and examples thereof include an electromagnetic induction heating apparatus.

Examples of the electromagnetic induction heating apparatus include those including an induction coil disposed close to the fixing member such as a heating roller, a shielding layer in which the induction coil is provided, and an insulating layer provided on a side opposite to the side in which the induction coil in the shielding layer is provided.

The heating roller is not particularly limited, and examples thereof include those formed of a magnetic substance, and a heat pipe.

The induction coil is preferably disposed on a side opposite to the region of the heating roller contacting the fixing member such as a pressurizing roller and an endless belt, in a state where a half of the cylinder portion of the heating roller is covered.

The recording medium is not particularly limited, and examples thereof include paper.

The image forming apparatus is not particularly limited, and examples thereof include fax machines and printers.

Next, a process cartridge according to one embodiment of the present invention will be described.

The process cartridge includes a photoconductor and a developing apparatus, and is detachably mountable on the main body of the image forming apparatus. The process cartridge may further include a charging apparatus, an exposure apparatus, a transfer apparatus, a cleaning apparatus, a static eliminator, and the like when necessary.

Figure 3:
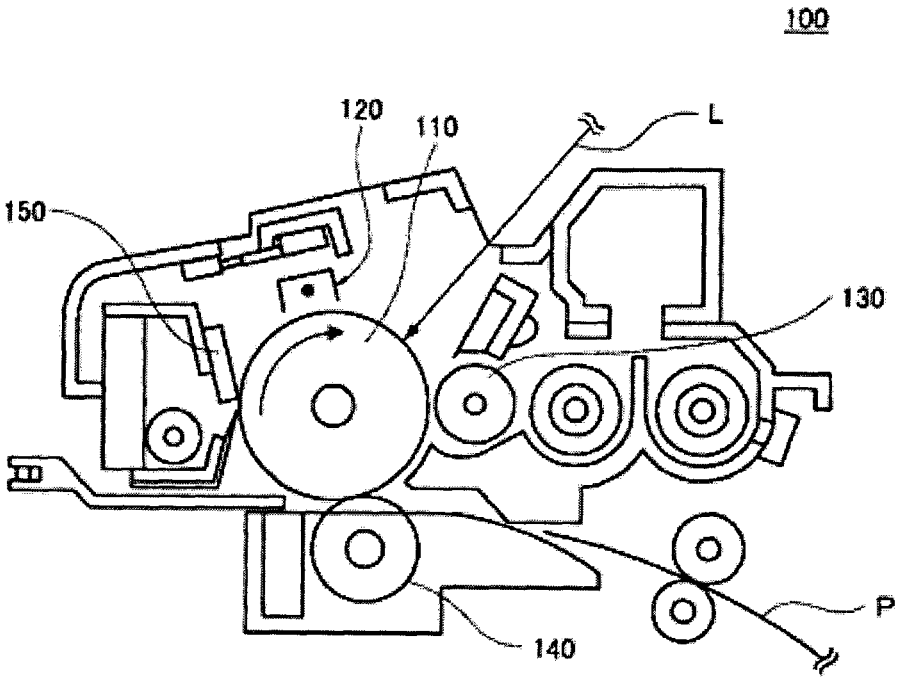
FIG. 3 is a schematic view showing a process cartridge according to one embodiment of the present invention.

FIG. 3 is a diagram showing a process cartridge according to one embodiment of the present invention. A process cartridge 100 accommodates a drum-like photoconductor 110 therein, and includes a charging apparatus 120, a developing apparatus 130, a transfer apparatus 140, and a cleaning apparatus 150.

Next, an image forming process by the process cartridge 100 will be described. First, the surface of the photoconductor 110 is charged by the charging apparatus 120 while the photoconductor 110 rotates in the direction of arrow. Then, an electrostatic latent image is formed on the surface of the photoconductor by exposure light L from an exposure apparatus (not shown). Next, the electrostatic latent image formed on the surface of the photoconductor is developed using the developer according to the embodiment by the developing apparatus 130 to form a toner image. Then, the toner image is transferred onto a recording medium P by the transfer apparatus 140, and printed out. Further, the surface of the photoconductor onto which the toner image is transferred is cleaned by the cleaning apparatus 150.

EXAMPLES

Hereinafter, the present invention will be more specifically described based on Examples, but the present invention will not be limited to Examples below. Parts mean parts by mass.

<Synthesis of Crystalline Polyester A1>

241 parts of sebacic acid, 31 parts of adipic acid, 164 parts of 1,4-butanediol, and 0.75 parts of titanium dihydroxybis (triethanolaminate) as a condensation catalyst were placed in a reaction tank including a cooling tube, a stirrer, and a nitrogen introducing pipe. Then, under a nitrogen stream, these materials were reacted at 180° C. for 8 hours while water generated was distilled away. Next, the temperature was gradually raised to 225° C., and under a nitrogen stream the reaction was made for 4 hours while water generated and 1,4-butanediol were distilled away. Then, the reaction was made under a reduced pressure of 5 mmHg to 20 mmHg until the weight average molecular weight reached 18,000. Thus, a crystalline polyester A1 having a melting point of 58° C. and a softening temperature of 56° C. was obtained.

<Synthesis of Crystalline Polyester A2>

283 parts of sebacic acid, 215 parts of 1,6-hexanediol, and 1 part of titanium dihydroxybis(triethanolaminate) as a condensation catalyst were placed in a reaction tank including a cooling tube, a stirrer, and a nitrogen introducing pipe. Then, under a nitrogen stream, these materials were reacted at 180° C. for 8 hours while water generated was distilled away. Next, the temperature was gradually raised to 220° C., and under a nitrogen stream the reaction was made for 4 hours while water generated and 1,6-hexanediol were distilled away. Then, the reaction was made under a reduced pressure of 5 mmHg to 20 mmHg until the weight average molecular weight reached 17,000. Thus, a crystalline polyester A2 having a melting point of 63° C. and a softening temperature of 63° C. was obtained.

<Synthesis of Crystalline Block Copolymer A3>

25 parts of 1,2-propylene glycol and 170 parts of methyl ethyl ketone (MEK) were placed in a reaction tank including a cooling tube, a stirrer, and a nitrogen introducing pipe, and stirred. Then, 147 parts of 4,4'-diphenylmethane diisocyanate (MDI) was added, and these materials were reacted at 80° C. for 5 hours. Thus, an MEK solution of polyurethane having an isocyanate group in the terminal was obtained.

202 parts of sebacic acid, 160 parts of 1,6-hexanediol, and 0.5 parts of tetrabutoxytitanate as a condensation catalyst were placed in a reaction tank including a cooling tube, a stirrer, and a nitrogen introducing pipe, and under a nitrogen stream, reacted at 180° C. for 8 hours while water generated was distilled away. Next, the temperature was gradually raised to 220° C., and under a nitrogen stream, the reaction was made for 4 hours while water generated and 1,6-hexanediol were distilled away. Then, the reaction was made under a reduced pressure of 5 mmHg to 20 mmHg until the weight average molecular weight reached 9,000. Thus, a polyester having a weight average molecular weight of 8,500 and a melting point of 63° C. was obtained.

A solution prepared by dissolving 320 parts of polyester in 320 parts of MEK was added to 340 parts of the MEK solution of polyurethane having an isocyanate group in the terminal, and the reaction was made under a nitrogen stream at 80° C. for 5 hours. Next, MEK was distilled away under reduced pressure. Thus, a crystalline block copolymer A3 having a weight average molecular weight of 26,000, a melting point of 62° C., and a softening temperature of 56° C. was obtained.

<Synthesis of Crystalline Urethane Modified Polyester A4>

202 parts of sebacic acid, 189 parts of 1,6-hexanediol, and 0.5 parts of dibutyltin oxide as a condensation catalyst were placed in a reaction tank including a cooling tube, a stirrer, and a nitrogen introducing pipe, and under a nitrogen stream, reacted at 180° C. for 8 hours while water generated was distilled away. Next, the temperature was gradually raised to 220° C., and under a nitrogen stream, the reaction was made for 4 hours while water generated and 1,6-hexanediol were distilled away. Then, the reaction was made under a reduced pressure of 5 mmHg to 20 mmHg until the weight average molecular weight reached 6,000. Thus, a polyester having a weight average molecular weight of 6,000 was obtained.

The obtained polyester was transferred into another reaction tank including a cooling tube, a stirrer, and a nitrogen introducing pipe, and 300 parts of ethyl acetate and 38 parts of 4,4'-diphenylmethane diisocyanate (MDI) were added thereto. Then, the reaction was made under a nitrogen stream at 80° C. for 5 hours. Next, ethyl acetate was distilled away under reduced pressure. Thus, a crystalline urethane modified polyester A4 having a weight average molecular weight of 10,000, a melting point of 64° C., and a softening temperature of 69° C. was obtained.

<Synthesis of Crystalline Polyurethane A5>

126 parts of 1,4-butanediol, 215 parts of 1,6-hexanediol, 100 parts of methyl ethyl ketone, and 341 parts of hexamethylene diisocyanate (HDI) were placed in a reaction tank including a cooling tube, a stirrer, and a nitrogen introducing pipe, and reacted under a nitrogen stream at 80° C. for 8 hours. Next, methyl ethyl ketone was distilled away under reduced pressure. Thus, a crystalline polyurethane A5 having a weight average molecular weight of 18,000, a melting point of 59° C., and a softening temperature of 69° C. was obtained.

<Synthesis of Crystalline Urethane Modified Polyester A6>

204 parts of sebacic acid, 13 parts of adipic acid, 136 parts of 1,6-hexanediol, and 0.5 parts of tetrabutoxytitanate as a condensation catalyst were placed in a reaction tank including a cooling tube, a stirrer, and a nitrogen introducing pipe, and under a nitrogen stream, reacted at 180° C. for 8 hours while water generated was distilled away. Next, the temperature was gradually raised to 220° C., and under a nitrogen stream, the reaction was made for 4 hours while water generated and 1,6-hexanediol were distilled away. Then, the reaction was made under a reduced pressure of 5 mmHg to 20 mmHg until the weight average molecular weight reached 20,000. Thus, a polyester having a weight average molecular weight of 20,000 was obtained.

The obtained polyester was transferred into another reaction tank including a cooling tube, a stirrer, and a nitrogen introducing pipe, and 200 parts of ethyl acetate and 15 parts of 4,4'-diphenylmethane diisocyanate (MDI) were added thereto. Then, the reaction was made under a nitrogen stream at 80° C. for 5 hours. Next, ethyl acetate was distilled away under reduced pressure. Thus, a crystalline urethane modified polyester resin A6 having a weight average molecular weight of 39,000, a melting point of 63° C., and a softening temperature of 64° C. was obtained.

<Synthesis of Crystalline Resin Precursor B1>

283 parts of sebacic acid, 215 parts of 1,6-hexanediol, and 1 part of titanium dihydroxybis(triethanolaminate) as a condensation catalyst were placed in a reaction tank including a cooling tube, a stirrer, and a nitrogen introducing pipe, and under a nitrogen stream, reacted at 180° C. for 8 hours while water generated was distilled away. Next, the temperature was gradually raised to 220° C., and under a nitrogen stream, the reaction was made for 4 hours while water generated and 1,6-hexanediol were distilled away. Then, the reaction was made under a reduced pressure of 5 mmHg to 20 mmHg until the weight average molecular weight reached 6,000. Thus, a polyester was obtained.

249 parts of the obtained polyester was transferred into another reaction tank including a cooling tube, a stirrer, and a nitrogen introducing pipe, and 250 parts of ethyl acetate and 829 parts of hexamethylene diisocyanate (HDI) were added. Then, the reaction was made under a nitrogen stream at 80° C. for 5 hours. Next, ethyl acetate was distilled away under reduced pressure. Thus, a crystalline polyurethane having a weight average molecular weight of 20,000, a melting point of 65° C., and a softening temperature of 76° C. was obtained.

247 parts of hexamethylene diisocyanate (HDI) and 247 parts of ethyl acetate were placed in a reaction tank including a cooling tube, a stirrer, and a nitrogen introducing pipe, and a solution prepared by dissolving 249 parts of crystalline polyurethane in 249 parts of ethyl acetate was added. The reaction was made under a nitrogen stream at 80° C. for 5 hours. Thus, a 50% by mass ethyl acetate solution of a crystalline resin precursor B1 having an isocyanate group in the terminal was obtained.

The obtained solution was used as a sample and measured by GPC. As a result, the crystalline resin precursor B1 had a weight average molecular weight of 20,000. Moreover, the solvent was removed from the 50% by mass ethyl acetate solution of the crystalline resin precursor B1 to obtain a sample, and the DSC of the sample was measured. As a result, the crystalline resin precursor B1 had a melting point of 65° C. and a softening temperature of 76° C.

<Synthesis of Non-Crystalline Polyester C1>

187.5 parts of neopentyl alcohol, 79.3 parts of ethylene oxide, 438.6 parts of terephthalic acid, and 0.21 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 5,700. Thus, a non-crystalline polyester C1 having a glass transition temperature of 60° C. was obtained.

<Synthesis of Non-Crystalline Polyester C2>

187.5 parts of neopentyl alcohol, 79.3 parts of ethylene oxide, 458.5 parts of terephthalic acid, and 0.22 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 8,000. Thus, a non-crystalline polyester C2 having a glass transition temperature of 64° C. was obtained.

<Synthesis of Non-Crystalline Polyester C3>

187.5 parts of neopentyl alcohol, 79.3 parts of ethylene oxide, 199.4 parts of terephthalic acid, 239.2 parts of isophthalic acid, and 0.21 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 5,800.

Thus, a non-crystalline polyester C3 having a glass transition temperature of 52° C. was obtained.

<Synthesis of Non-Crystalline Polyester C4>

190 parts of an ethylene oxide adduct of bisphenol A, 207 parts of a propylene oxide adduct of bisphenol A, 194 parts of dimethyl terephthalate, and 0.18 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 7,000. Thus, a non-crystalline polyester C4 having a glass transition temperature of 63° C. was obtained.

<Synthesis of Non-Crystalline Polyester C5>

190 parts of an ethylene oxide adduct of bisphenol A, 63 parts of neopentyl glycol, 175 parts of dimethyl terephthalate, 19 parts of dimethyl isophthalate, and 0.13 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 7,000. Thus, a non-crystalline polyester C5 having a glass transition temperature of 53° C. was obtained.

<Synthesis of Non-Crystalline Polyester C6>

63 parts of neopentyl glycol, 37 parts of ethylene glycol, 175 parts of dimethyl terephthalate, 19 parts of dimethyl isophthalate, and 0.09 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 7,000. Thus, a non-crystalline polyester C6 having a glass transition temperature of 57° C. was obtained.

<Synthesis of Block Copolymer D1>

75 parts of the non-crystalline polyester 1, 9 parts of 1,6-hexanediol, 16 parts of sebacic acid, and 0.03 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 9,200. Thus, a block copolymer D1 having a glass transition temperature of 42° C., a melting point of 62° C., and a softening temperature of 85° C. was obtained.

<Synthesis of Block Copolymer D2>

The reaction was performed in the same manner as in the case of the block copolymer D1 except that the non-crystalline polyester 2 was used instead of the non-crystalline polyester 1. Thus, a block copolymer D2 having a glass transition temperature of 46° C., a melting point of 62° C., and a softening temperature of 87° C. was obtained.

<Synthesis of Block Copolymer D3>

The reaction was performed in the same manner as in the case of the block copolymer 1 except that the non-crystalline polyester 3 was used instead of the non-crystalline polyester 1. Thus, a block copolymer D3 having a glass transition temperature of 38° C., a melting point of 62° C., and a softening temperature of 84° C. was obtained.

<Synthesis of Block Copolymerization Resin D4>

50 parts of the non-crystalline polyester 4, 18 parts of 1,6-hexanediol, 32 parts of sebacic acid, and 0.03 parts of tetrabutoxytitanate as a condensation catalyst were placed in a reaction tank including a cooling tube, a stirrer, and a nitrogen introducing pipe, and under a nitrogen stream, reacted at 180° C. for 8 hours while water generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 7,900. Thus, a block copolymer D4 having a glass transition temperature of −25° C., a melting point of 50° C., and a softening temperature of 60° C. was obtained.

<Synthesis of Block Copolymer D5>

40 parts of the non-crystalline polyester 4, 15 parts of 1,6-hexanediol, 25 parts of sebacic acid, and 0.03 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 8,300. Thus, a block copolymer D5 having a glass transition temperature of −10° C., a melting point of 51° C., and a softening temperature of 62° C. was obtained.

<Synthesis of Block Copolymer D6>

75 parts of the non-crystalline polyester 4, 9 parts of 1,6-hexanediol, 16 parts of sebacic acid, and 0.03 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 9,200. Thus, a block copolymer D6 having a glass transition temperature of 4° C., a melting point of 61° C., and a softening temperature of 83° C. was obtained.

<Synthesis of Block Copolymer D7>

90 parts of the non-crystalline polyester 4, 4 parts of 1,6-hexanediol, 16 parts of sebacic acid, and 0.03 parts of tetrabutoxytitanate as a condensation catalyst were placed in a reaction tank including a cooling tube, a stirrer, and a nitrogen introducing pipe, and under a nitrogen stream, reacted at 180° C. for 8 hours while methanol generated was distilled away. Next, the temperature was gradually raised to 230° C., and under a nitrogen stream, the reaction was made for 4 hours while methanol generated was distilled away. Then, the reaction was made under a reduced pressure of 5 mmHg to 20 mmHg until the weight average molecular weight reached 9,000. Thus, a block copolymer D7 having a glass transition temperature of 42° C., a melting point of 62° C., and a softening temperature of 108° C. was obtained.

<Synthesis of Block Copolymer D8>

The reaction was performed in the same manner as in the case of the block copolymer 1 except that the non-crystalline polyester 5 was used instead of the non-crystalline polyester 1. Thus, a block copolymer D8 having a glass transition temperature of 15° C., a melting point of 62° C., and a softening temperature of 83° C. was obtained.

<Synthesis of Block Copolymer D9>

The reaction was performed in the same manner as in the case of the block copolymer 1 except that the non-crystalline polyester 6 was used instead of the non-crystalline polyester 1. Thus, a block copolymer D9 having a glass transition temperature of 36° C., a melting point of 62° C., and a softening temperature of 85° C. was obtained.

<Melting Point Ta>

Using a differential scanning calorimeter (DSC) TA-60 WS and DSC-60 (made by SHIMADZU Corporation), the melting point was measured. Specifically, a sample was molten at 130° C., and the temperature was lowered at 1.0° C./min to 70° C., and lowered at 0.5° C./min to 10° C. Next, the temperature was raised at 20° C./min. The temperature at an endothermic peak existing at 20° C. to 100° C. was defined as Ta*. If several endothermic peaks were found, the temperature at an endothermic peak having the largest amount of heat to be absorbed was defined as Ta*. Further, the sample was preserved at (Ta*−10°) C. for 6 hours, and then preserved at (Ta*−15°) C. for 6 hours. Next, the sample was cooled at 10° C./min to 0° C. Then, the temperature was raised at 20° C./min. The temperature at an endothermic peak was defined as a melting point Ta. If several endothermic peaks were found, the temperature at an endothermic peak having the largest amount of heat to be absorbed was defined as a melting point Ta.

<Softening Temperature Tb>

Using an elevated Flowtester CFT-500D (made by SHIMADZU Corporation), the softening temperature was measured. Specifically, while 1 g of a sample was heated at a temperature raising rate of 6° C./min, a load of 1.96 MPa was applied to the sample with a plunger to extrude the sample from a nozzle having diameter of 1 mm and a length of 1 mm. The amount of the plunger in the Flowtester to descend was plotted against the temperature. At this time, the temperature at which the half amount of the sample was flowed out was defined as a softening temperature Tb.

<Weight Average Molecular Weight>

Using a GPC-8220GPC (made by Tosoh Corporation) and 3 columns TSKgel SuperHZM-H 15 cm (made by Tosoh Corporation), the weight average molecular weight was measured. Specifically, a sample was dissolved in tetrahydrofuran (made by Wako Pure Chemical Industries, Ltd.) containing a stabilizer to prepare a 0.15% by mass solution. The solution was filtered using a filter having a pore diameter of 0.2 μm, and 100 μl of the filtrate was injected. At this time, the weight average molecular weight was measured under a 40° C. environment at a flow rate of 0.35 ml/min. The molecular weight of the sample was calculated from the relationship between the logarithmic value of the calibration curve formed using monodisperse polystyrene as a standard sample and the number of counts. For monodisperse polystyrene, Showdex STANDARD Std. Nos. S-7300, S-210, S-390, S-875, S-1980, S-10.9, S-629, S-3.0, and S-0.580 (made by Showa Denko K.K.) were used. For the detector, an RI (refractive index) detector was used.

<Glass Transition Temperature of Non-Crystalline Polyester>

Using a differential scanning calorimeter (DSC) TA-60WS and DSC-60 (made by SHIMADZU Corporation), the glass transition temperature was measured. Specifically, first, the temperature of a non-crystalline polyester was raised at a temperature raising rate of 10° C./min from 20° C. to 150° C., and lowered at a cooling rate of 10° C./min from 150° C. to 20° C. Next, the temperature was raised at 10° C./min from 20° C. to 150°, and the glass transition temperature was measured.

<Glass Transition Temperature of Block Copolymer>

Using a differential scanning calorimeter (DSC) TA-60 WS and DSC-60 (made by SHIMADZU Corporation), the glass transition temperature was measured. Specifically, the temperature of a block copolymer was raised at a temperature raising rate of 10° C./min from 20° C. to 150° C., and the glass transition temperature was measured.

<Poor Solubility in Ethyl Acetate>

A non-crystalline resin was charged into a Rotoplex mill (made by HOSOKAWA ALPINE AG), and crushed using a 1 mm mesh. Next, 40 parts of the crushed product and 100 parts of ethyl acetate were placed in a screw top vial, and left in a hot water bath at 50° C. for 12 hours. Then, using a spectrophotometer V-660DS (JASCO Corporation), the light transmittance at a wavelength of 500 nm at an optical path length of 1 cm was measured.

The properties of the crystalline resins are shown in Table 1.

TABLE 1

| Crystalline resin | Melting point Ta[° C.] | Softening temp. Tb[° C.] | Tb/Ta |
|---|---|---|---|
| Polyester A1 | 58 | 56 | 0.97 |
| Polyester A2 | 63 | 63 | 1.00 |
| Block copolymer A3 | 62 | 56 | 0.90 |
| Urethane modified polyester A4 | 64 | 69 | 1.08 |
| Polyurethane A5 | 59 | 69 | 1.17 |

The properties of the non-crystalline resins are shown in Tables 2 and 3.

TABLE 2

| Non-crystalline resin | Glass transition temperature [° C.] | Poor solubility in acetic acid ester [%] |
|---|---|---|
| Polyester C1 | 60 | 2.13 |
| Polyester C2 | 62 | 1.65 |
| Polyester C3 | 52 | 96.3 |
| Polyester C4 | 63 | 2.04 |
| Polyester C5 | 53 | 2.10 |
| Polyester C6 | 57 | 2.12 |

TABLE 3

| Block copolymer | Melting point Ta[° C.] | Softening temp. Tb[° C.] | Tb/Ta | Poor solubility in acetic acid ester [%] |
|---|---|---|---|---|
| D1 | 62 | 85 | 1.37 | 1.74 |
| D2 | 62 | 87 | 1.40 | 2.13 |
| D3 | 62 | 84 | 1.35 | 98.89 |
| D4 | 50 | 60 | 1.20 | 13.55 |
| D5 | 51 | 62 | 1.22 | 7.61 |
| D6 | 61 | 83 | 1.36 | 1.95 |
| D7 | 62 | 108 | 1.74 | 3.12 |
| D8 | 62 | 83 | 1.34 | 4.01 |
| D9 | 62 | 85 | 1.37 | 2.10 |

<Production of Masterbatch 1 of Pigment>

18 parts of a yellow pigment C.I. Pigment Yellow 185 (made by BASF SE), 82 parts of the block copolymer D1, and 15 parts of ion exchange water were mixed, and kneaded with an open roll mill kneader Kneadex (made by NIPPON COKE & ENGINEERING CO., LTD.) to obtain a masterbatch of a pigment. Specifically, kneading was started from 100° C., and the temperature was gradually lowered to 50° C.

<Production of Masterbatches 2 to 9 of Pigment>

Masterbatches 2 to 9 of a pigment were obtained in the same manner as in the case of the masterbatch 1 of a pigment except that the block copolymers D2 to 9 were used instead of the block copolymer D1.

<Production of Masterbatch 10 of Pigment>

A masterbatch 10 of a pigment was obtained in the same manner as in the case of the masterbatch 1 of a pigment except that the non-crystalline polyester C1 was used instead of the block copolymer D1.

<Production of Masterbatch 11 of Pigment>

A masterbatch 11 of a pigment was obtained in the same manner as in the case of the masterbatch 1 of a pigment except that the amount of the yellow pigment C.I. Pigment Yellow 185 (made by BASF SE) to be added was changed to 11.5 parts and that of the block copolymer D1 was changed to 88.5 parts.

<Production of Masterbatch 12 of Pigment>

A masterbatch 12 of a pigment was obtained in the same manner as in the case of the masterbatch 1 of a pigment except that the amount of the yellow pigment C.I. Pigment Yellow 185 (made by BASF SE) to be added was changed to 8.5 parts and that of the block copolymer D1 was changed to 91.5 parts.

<Production of Masterbatch 13 of Pigment>

A masterbatch 13 of a pigment was obtained in the same manner as in the case of the masterbatch 1 of a pigment except that the amount of the yellow pigment C.I. Pigment Yellow 185 (made by BASF SE) to be added was changed to 39 parts and that of the block copolymer D1 was changed to 61 parts.

<Production of Masterbatch 14 of Pigment>

A masterbatch 14 of a pigment was obtained in the same manner as in the case of the masterbatch 1 of a pigment except that a magenta pigment C.I. Pigment Red 122 (made by Clariant International Ltd.) was used instead of a yellow pigment C.I. Pigment Yellow 185 (made by BASF SE).

<Production of Masterbatch 15 of Pigment>

A masterbatch 15 of a pigment was obtained in the same manner as in the case of the masterbatch 1 of a pigment except that a cyan pigment C.I. Pigment Blue 15:3 (made by Dainichiseika Color & Chemicals Mfg. Co., Ltd.) was used instead of a yellow pigment C.I. Pigment Yellow 185 (made by BASF SE).

<Production of Masterbatch 16 of Pigment>

A masterbatch 17 of a pigment was obtained in the same manner as in the case of the masterbatch 1 of a pigment except that the non-crystalline polyester C3 was used instead of the block copolymer D1.

<Production of Masterbatch 17 of Pigment>

A masterbatch 17 of a pigment was obtained in the same manner as in the case of the masterbatch 1 of a pigment except that 58 parts of the crystalline polyester A1 was used instead of 82 parts of the block copolymer D1, and the amount of the yellow pigment C.I. Pigment Yellow 185 (made by BASF SE) to be added was changed to 42 parts.

<Production of Masterbatch 18 of Pigment>

A masterbatch 18 of a pigment was obtained in the same manner as in the case of the masterbatch 12 of a pigment except that the non-crystalline polyester C1 was used instead of the block copolymer D1.

<Production of Masterbatch 19 of Pigment>

A masterbatch 19 of a pigment was obtained in the same manner as in the case of the masterbatch 1 of a pigment except that the non-crystalline polyester C2 was used instead of the block copolymer D1.

<Production of Masterbatch 20 of Pigment>

A masterbatch 20 of a pigment was obtained in the same manner as in the case of the masterbatch 12 of a pigment except that the block copolymer D7 was used instead of the block copolymer D1.

The configuration of the masterbatch of a pigment is shown in Table 4.

TABLE 4

| | Pigment | | Resin | |
|---|---|---|---|---|
| Masterbatch of pigment | Color | Mass ratio | Kind | Mass ratio |
| 1 | Yellow | 18 | Block copolymer D1 | 82 |
| 2 | Yellow | 18 | Block copolymer D2 | 82 |
| 3 | Yellow | 18 | Block copolymer D3 | 82 |
| 4 | Yellow | 18 | Block copolymer D4 | 82 |
| 5 | Yellow | 18 | Block copolymer D5 | 82 |
| 6 | Yellow | 18 | Block copolymer D6 | 82 |
| 7 | Yellow | 18 | Block copolymer D7 | 82 |
| 8 | Yellow | 18 | Block copolymer D8 | 82 |
| 9 | Yellow | 18 | Block copolymer D9 | 82 |
| 10 | Yellow | 18 | Non-crystalline polyester C1 | 82 |
| 11 | Yellow | 11.5 | Block copolymer D1 | 88.5 |
| 12 | Yellow | 8.5 | Block copolymer D1 | 91.5 |
| 13 | Yellow | 39 | Block copolymer D1 | 61 |
| 14 | Magenta | 18 | Block copolymer D1 | 82 |
| 15 | Cyan | 18 | Block copolymer D1 | 82 |
| 16 | Yellow | 18 | Non-crystalline polyester C3 | 82 |
| 17 | Yellow | 42 | Crystalline polyester A1 | 58 |
| 18 | Yellow | 8.5 | Non-crystalline polyester C1 | 91.5 |
| 19 | Yellow | 18 | Non-crystalline polyester C2 | 82 |
| 20 | Yellow | 8.5 | Block copolymer D7 | 91.5 |

<Production of Layered Inorganic Mineral Masterbatch>

100 parts of the crystalline polyester A1, 100 parts of Kraton APA (made by Southern Clay Products, Inc.) that was montmorillonite in which at least part of cations existing between layers was substituted by a quaternary ammonium ion having a benzyl group, and 50 parts of ion exchange water were mixed, and kneaded using an open roll mill kneader Kneadex (made by NIPPON COKE & ENGINEERING CO., LTD.) to obtain a masterbatch of an organically modified layered inorganic mineral. Specifically, kneading was started from 90° C., and the temperature was gradually lowered to 50° C.

<Production of Wax Dispersion Liquid>

20 parts of paraffin wax HNP-9 having a melting point of 75° C. (made by NIPPON SEIRO CO., LTD.) and 80 parts of ethyl acetate were placed in a container including a cooling tube, a thermometer, and a stirrer, and dissolved by raising the temperature to 78° C. Then, the temperature was lowered to 30° C. in 1 hour while stirring. Next, using an Ultra Visco Mill (made by Aimex Co., Ltd.), wet grinding was performed under the condition of the feed rate of 1.0 kg/h, the circumferential speed of the disk of 10 m/s, the filling rate of 80% by volume of a zirconia bead having a particle size of 0.5 mm, and the number of passes of 6 to obtain a wax dispersion liquid.

Example 1

50 parts of crystalline polyester A1 and 50 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 37 parts of the masterbatch 1 of a pigment, and 37 parts of ethyl acetate were added, and these materials were stirred at 50° C. and 10000 rpm using a TK homomixer (made by PRIMIX Corporation). Further, 30 parts of the 50% by mass ethyl acetate solution of the prepolymer was added, and the materials were stirred at 50° C. and 10000 rpm using the TK homomixer (made by PRIMIX Corporation) to obtain a first solution.

90 parts of ion exchange water, 3 parts of a 5% by mass aqueous solution of a polyoxyethylene lauryl ether nonionic surfactant NL450 (made by Dai-ichi Kogyo Seiyaku Co., Ltd.), and 10 parts of ethyl acetate were placed in a container including a stirrer and a thermometer, and stirred at 40° C. to obtain an aqueous medium.

50 parts of the first solution kept at 50° C. was added to the aqueous medium kept at 40° C., and the solution was stirred at 40° C. to 50° C. and 13000 rpm for 1 minute using a TK homomixer (made by PRIMIX Corporation) to obtain a second solution.

The second solution was placed in a container including a stirrer and a thermometer, and the solvent was removed at 60° C. for 6 hours to obtain a slurry.

100 parts of the slurry was filtered by reducing pressure. Next, 100 parts of ion exchange water was added to the filtered cake. These were stirred using a TK homomixer (made by PRIMIX Corporation) at 6000 rpm for 5 minutes, and filtered. Further, 100 parts of a 10% by mass sodium hydroxide aqueous solution was added to the filtered cake. These were stirred using a TK homomixer (made by PRIMIX Corporation) at 6000 rpm for 10 minutes, and filtered by reducing pressure. Next, 100 parts of a 10% by mass hydrochloric acid was added to the filtered cake. These were stirred using a TK homomixer (made by PRIMIX Corporation) at 6000 rpm for 5 minutes, and filtered. Further, 300 parts of ion exchange water was added to the filtered cake. These were stirred using a TK homomixer (made by PRIMIX Corporation) at 6000 rpm for 5 minutes, and filtered. This operation was repeated twice.

Using a circulated air dryer, the filtered cake was dried at 45° C. for 48 hours, and sieved with a mesh having an opening of 75 μm to obtain a mother particle.

Using a Henschel mixer, 100 parts of the mother particle and 1 part of hydrophobic silica HDK-2000 (made by Wacker Chemie AG) were mixed to obtain a toner having a volume average particle size of 5.8 μm, a degree of crystallization of 21%, $T_{sh\ 2nd}/T_{sh\ 1st}$ of 0.98, a storage elastic modulus at 160° C. of $5.7\times10^3$ Pa, an average circularity of 0.982, and a domain diameter of the island of 1.0 μm.

Example 2

The operation was performed in the same manner as in Example 1 except that the masterbatch 2 of a pigment was used instead of the masterbatch 1 of a pigment. Thus, a toner having a volume average particle size of 5.9 μm, a degree of crystallization of 21%, $T_{sh\ 2nd}/T_{sh\ 1st}$ of 0.98, a storage elastic modulus at 160° C. of $5.8\times10^3$ Pa, an average circularity of 0.983, and a domain diameter of the island of 1.2 μm was obtained.

Example 3

The operation was performed in the same manner as in Example 1 except that the masterbatch 4 of a pigment was used instead of the masterbatch 1 of a pigment. Thus, a toner having a volume average particle size of 5.4 μm, a degree of crystallization of 22%, $T_{sh\ 2nd}/T_{sh\ 1st}$ of 0.96, a storage elastic modulus at 160° C. of $2.3\times10^3$ Pa, an average circularity of 0.983, and a domain diameter of the island of 1.5 μm was obtained.

Example 4

The operation was performed in the same manner as in Example 1 except that the masterbatch 5 of a pigment was used instead of the masterbatch 1 of a pigment. Thus, a toner having a volume average particle size of 5.5 μm, a degree of crystallization of 23%, $T_{sh\ 2nd}/T_{sh\ 1st}$ of 0.98, a storage elastic modulus at 160° C. of $3.0\times10^3$ Pa, an average circularity of 0.983, and a domain diameter of the island of 1.2 μm was obtained.

Example 5

The operation was performed in the same manner as in Example 1 except that the masterbatch 6 of a pigment was used instead of the masterbatch 1 of a pigment. Thus, a toner having a volume average particle size of 5.6 μm, a degree of crystallization of 21%, $T_{sh\ 2nd}/T_{sh\ 1st}$ of 0.98, a storage elastic modulus at 160° C. of $5.0\times10^3$ Pa, an average circularity of 0.983, and a domain diameter of the island of 1.2 μm was obtained.

Example 6

The operation was performed in the same manner as in Example 1 except that the masterbatch 7 of a pigment was used instead of the masterbatch 1 of a pigment. Thus, a toner having a volume average particle size of 5.8 μm, a degree of crystallization of 21%, $T_{sh\ 2nd}/T_{sh\ 1st}$ of 0.98, a storage elastic modulus at 160° C. of $5.6\times10^3$ Pa, an average circularity of 0.983, and a domain diameter of the island of 1.3 μm was obtained.

Example 7

The operation was performed in the same manner as in Example 1 except that the masterbatch 8 of a pigment was used instead of the masterbatch 1 of a pigment. Thus, a toner having a volume average particle size of 5.6 μm, a degree of crystallization of 21%, $T_{sh\ 2nd}/T_{sh\ 1st}$ of 0.98, a storage elastic modulus at 160° C. of $5.1\times10^3$ Pa, an average circularity of 0.983, and a domain diameter of the island of 1.3 μm was obtained.

Example 8

The operation was performed in the same manner as in Example 1 except that the masterbatch 9 of a pigment was used instead of the masterbatch 1 of a pigment. Thus, a toner having a volume average particle size of 5.8 μm, a degree of crystallization of 21%, $T_{sh\ 2nd}/T_{sh\ 1st}$ of 0.98, a storage elastic modulus at 160° C. of $5.6\times10^3$ Pa, an average circularity of 0.983, and a domain diameter of the island of 1.2 μm was obtained.

Example 9

The operation was performed in the same manner as in Example 1 except that the crystalline polyester A2 was used instead of the crystalline polyester A1. Thus, a toner having a volume average particle size of 5.9 μm, a degree of crystallization of 21%, $T_{sh\ 2nd}/T_{sh\ 1st}$ of 0.98, a storage elastic modulus at 160° C. of $5.9\times10^3$ Pa, an average circularity of 0.983, and a domain diameter of the island of 1.0 μm was obtained.

Example 10

The operation was performed in the same manner as in Example 1 except that the crystalline block copolymer A3 was used instead of the crystalline polyester A1. Thus, a toner having a volume average particle size of 6.1 μm, a degree of crystallization of 21%, $T_{sh\ 2nd}/T_{sh\ 1st}$ of 0.95, a storage elastic modulus at 160° C. of $6.3\times10^3$ Pa, an average circularity of 0.983, and a domain diameter of the island of 1.0 μm was obtained.

Example 11

The operation was performed in the same manner as in Example 1 except that the crystalline urethane modified polyester A4 was used instead of the crystalline polyester A1. Thus, a toner having a volume average particle size of 6.1 μm, a degree of crystallization of 21%, $T_{sh\ 2nd}/T_{sh\ 1st}$ of 0.93, a storage elastic modulus at 160° C. of $6.5\times10^3$ Pa, an average circularity of 0.983, and a domain diameter of the island of 1.1 μm was obtained.

Example 12

The operation was performed in the same manner as in Example 1 except that the crystalline polyurethane A5 was used instead of the crystalline polyester A1. Thus, a toner having a volume average particle size of 6.2 μM, a degree of crystallization of 21%, $T_{sh\ 2nd}/T_{sh\ 1st}$ of 0.90, a storage elastic modulus at 160° C. of $9.8\times10^3$ Pa, an average circularity of 0.983, and a domain diameter of the island of 1.1 μm was obtained.

Example 13

The operation was performed in the same manner as in Example 1 except that the masterbatch 10 of a pigment was used instead of the masterbatch 1 of a pigment. Thus, a toner having a volume average particle size of 5.7 μm, a degree of crystallization of 21%, $T_{sh\ 2nd}/T_{sh\ 1st}$ of 0.97, a storage elastic modulus at 160° C. of $5.5\times10^3$ Pa, an average circularity of 0.983, and a domain diameter of the island of 1.4 μm was obtained.

Example 14

65 parts of the crystalline polyester A1 and 65 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 30 parts of the masterbatch 1 of a pigment, and 30 parts of ethyl acetate were added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.5 μm, a degree of crystallization of 22%, $T_{sh\ 2nd}/T_{sh\ 1st}$ of 0.98, a storage elastic modulus at 160° C. of $1.5\times10^3$ Pa, an average circularity of 0.985, and a domain diameter of the island of 1.5 μm was obtained.

Example 15

42 parts of the crystalline polyester A1 and 42 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 40 parts of the masterbatch 11 of a pigment, and 40 parts of ethyl acetate were added, and these materials were stirred using a TK homomixer (made by PRIMIX Corporation) at 50° C. and 10000 rpm. Further, 26 parts of a 50% by mass ethyl acetate solution of the prepolymer was added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.9 μm, a degree of crystallization of 18%, $T_{sh\ 2nd}/T_{sh\ 1st}$ of 0.97, a storage elastic modulus at 160° C. of $5.8\times10^3$ Pa, an average circularity of 0.983, and a domain diameter of the island of 1.6 μm was obtained.

Example 16

35 parts of the crystalline polyester A1 and 35 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 50 parts of the masterbatch 12 of a pigment, and 50 parts of ethyl acetate were added, and these materials were stirred using a TK homomixer (made by PRIMIX Corporation) at 50° C. and 10000 rpm. Further, 20 parts of a 50% by mass ethyl acetate solution of the prepolymer was added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.8 μm, a degree of crystallization of 15%, $T_{sh\ 2nd}/T_{sh\ 1st}$ of 0.96, a storage elastic modulus at 160° C. of $5.9\times10^3$ Pa, an average circularity of 0.983, and a domain diameter of the island of 1.8 μm was obtained.

Example 17

65 parts of the crystalline polyester A1 and 65 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 10 parts of the masterbatch 13 of a pigment, and 10 parts of ethyl acetate were added, and these materials were stirred using a TK homomixer (made by PRIMIX Corporation) at 50° C. and 10000 rpm. Further, 40 parts of a 50% by mass ethyl acetate solution of the prepolymer was added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.6 μm, a degree of crystallization of 25%, $T_{sh\ 2nd}/T_{sh\ 1st}$ of 0.98, a storage elastic modulus at 160° C. of $5.5\times10^3$ Pa, an average circularity of 0.983, and a domain diameter of the island of 0.8 μm was obtained.

Example 18

The operation was performed in the same manner as in Example 1 except that the masterbatch 14 of a pigment was used instead of the masterbatch 1 of a pigment. Thus, a toner having a volume average particle size of 5.9 μm, a degree of crystallization of 21%, $T_{sh\ 2nd}/T_{sh\ 1st}$ of 0.98, a storage elastic modulus at 160° C. of $5.7\times10^3$ Pa, an average circularity of 0.983, and a domain diameter of the island of 1.2 μM was obtained.

Example 19

The operation was performed in the same manner as in Example 1 except that the masterbatch 15 of a pigment was used instead of the masterbatch 1 of a pigment. Thus, a toner having a volume average particle size of 5.8 μm, a degree of crystallization of 21%, $T_{sh\ 2nd}/T_{sh\ 1st}$ of 0.98, a storage elastic modulus at 160° C. of $5.7\times10^3$ Pa, an average circularity of 0.983, and a domain diameter of the island of 0.8 μm was obtained.

Example 20

50 parts of the crystalline polyester A1, 15 parts of the crystalline polyester A6, and 65 parts of ethyl acetate were placed in a container including a thermometer and a stirrer, and dissolved by raising the temperature to a temperature equal to or more than the melting point of the crystalline polyester A6. Next, 25 parts of the wax dispersion liquid, 2 parts of the masterbatch of the layered inorganic mineral, 30 parts of the masterbatch 1 of a pigment, and 30 parts of ethyl acetate were added, and these materials were stirred using a TK homomixer (made by PRIMIX Corporation) at 50° C. and 10000 rpm to obtain a first solution.

The operation was performed in the same manner as in Example 1 except that the obtained first solution was used.

Thus, a toner having a volume average particle size of 5.8 μm, a degree of crystallization of 22%, $T_{sh\ 2nd}/T_{sh\ 1st}$ of 0.98, a storage elastic modulus at 160° C. of $5.7\times10^3$ Pa, an average circularity of 0.983, and a domain diameter of the island of 1.6 μm was obtained.

Example 21

45 parts of the crystalline polyester A1 and 45 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 30 parts of the masterbatch 18 of a pigment, and 50 parts of ethyl acetate were added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.8 μm, a degree of crystallization of 15%, $T_{sh\ 2nd}/T_{sh\ 1st}$ of 0.96, a storage elastic modulus at 160° C. of $5.8\times10^3$ Pa, an average circularity of 0.980, and a domain diameter of the island of 2.5 μm was obtained.

Example 22

The operation was performed in the same manner as in Example 1 except that the masterbatch 19 of a pigment was used instead of the masterbatch 1 of a pigment. Thus, a toner having a volume average particle size of 5.7 μm, a degree of crystallization of 21%, $T_{sh\ 2nd}/T_{sh\ 1st}$ of 0.97, a storage elastic modulus at 160° C. of $5.6\times10^3$ Pa, an average circularity of 0.983, and a domain diameter of the island of 2.2 μm was obtained.

Example 23

35 parts of the crystalline polyester A1 and 35 parts of ethyl acetate were placed in a container including a thermometer and a stirrer, and dissolved by raising the temperature to a temperature equal to or more than the melting point of the crystalline polyester A1. Next, 25 parts of the wax dispersion liquid, 2 parts of the masterbatch of the layered inorganic mineral, 50 parts of the masterbatch 20 of a pigment, and 50 parts of ethyl acetate were added, and these materials were stirred using a TK homomixer (made by PRIMIX Corporation) at 50° C. and 10000 rpm. Further, 20 parts of a 50% by mass ethyl acetate solution of the prepolymer was added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.7 μm, a degree of crystallization of 14%, $T_{sh\ 2nd}/T_{sh\ 1st}$ of 0.96, a storage elastic modulus at 160° C. of $5.5\times10^3$ Pa, an average circularity of 0.983, and a domain diameter of the island of 2.0 μm was obtained.

Comparative Example 1

The operation was performed in the same manner as in Example 1 except that the masterbatch 3 of a pigment was used instead of the masterbatch 1 of a pigment. Thus, a toner having a volume average particle size of 6.2 μM, a degree of crystallization of 21%, $T_{sh\ 2nd}/T_{sh\ 1st}$ of 0.98, a storage elastic modulus at 160° C. of $5.6\times10^3$ Pa, an average circularity of 0.983, and a domain diameter of the island of 1.3 μm was obtained.

Comparative Example 2

The operation was performed in the same manner as in Example 1 except that the masterbatch 16 of a pigment was used instead of the masterbatch 1 of a pigment. Thus, a toner having a volume average particle size of 6.1 μm, a degree of crystallization of 21%, $T_{sh\ 2nd}/T_{sh\ 1st}$ of 0.98, a storage elastic modulus at 160° C. of $5.4\times10^3$ Pa, and an average circularity of 0.980 was obtained.

Comparative Example 3

86 parts of the crystalline polyester 1 and 86 parts of ethyl acetate were placed in a container including a thermometer and a stirrer, and dissolved by raising the temperature to a temperature equal to or more than the melting point of the crystalline polyester 1. Next, 25 parts of the wax dispersion liquid, 2 parts of the masterbatch of the layered inorganic mineral, 16 parts of the masterbatch 17 of a pigment, and 16 parts of ethyl acetate were added, and these materials were stirred using a TK homomixer (made by PRIMIX Corporation) at 50° C. and 10000 rpm to obtain a first solution.

The operation was performed in the same manner as in Example 1 except that the obtained first solution was used. Thus, a toner having a volume average particle size of 5.6 μm, a degree of crystallization of 35%, $T_{sh\ 2nd}/T_{sh\ 1st}$ of 0.97, a storage elastic modulus at 160° C. of $6.0\times10^3$ Pa, and an average circularity of 0.988 was obtained.

The configuration of the toner is shown in Table 5.

TABLE 5

| | Crystalline resin | Non-crystalline resin | Block copolymer |
|---|---|---|---|
| Ex. 1 | Polyester A1 | — | D1 |
| Ex. 2 | Polyester A1 | — | D2 |
| Ex. 3 | Polyester A1 | — | D4 |
| Ex. 4 | Polyester A1 | — | D5 |
| Ex. 5 | Polyester A1 | — | D6 |
| Ex. 6 | Polyester A1 | — | D7 |
| Ex. 7 | Polyester A1 | — | D8 |
| Ex. 8 | Polyester A1 | — | D9 |
| Ex. 9 | Polyester A2 | — | D1 |
| Ex. 10 | Block copolymer A3 | — | D1 |
| Ex. 11 | Urethane modified polyester A4 | — | D1 |
| Ex. 12 | Polyurethane A5 | — | D1 |
| Ex. 13 | Polyester A1 | Polyester C1 | — |
| Ex. 14 | Polyester A1 | — | D1 |
| Ex. 15 | Polyester A1 | — | D1 |
| Ex. 16 | Polyester A1 | — | D1 |
| Ex. 17 | Polyester A1 | — | D1 |
| Ex. 18 | Polyester A1 | — | D1 |
| Ex. 19 | Polyester A1 | — | D1 |
| Ex. 20 | Polyester A1 Polyester A6 | — | D1 |
| Ex. 21 | Polyester A1 | Polyester C1 | — |
| Ex. 22 | Polyester A1 | Polyester C2 | — |
| Ex. 23 | Polyester A1 | — | D7 |
| Comp. Ex. 1 | Polyester A1 | — | D3 |
| Comp. Ex. 2 | Polyester A1 | Polyester C3 | — |
| Comp. Ex. 3 | Polyester A1 | — | — |

<Volume Average Particle Size>

Using a Coulter Multisizer III (made by Beckman Coulter, Inc.), the volume average particle size of the toner was measured. At this time, the diameter of an aperture was 100 μm, and a Beckman Coulter Multisizer 3 Version 3.51 (made by Beckman Coulter, Inc.) was used as analysis software. Specifically, 10 mg of the toner was added to 5 mL of a 10% by mass surfactant (alkylbenzene sulfonic acid salt) NEOGEN SC-A (made by Dai-ichi Kogyo Seiyaku Co., Ltd.), and dispersed using an ultrasonic dispersing machine for 1 minute. Then, 25 mL of an ISOTON III (made by Beckman Coulter, Inc.) was added, and dispersed using an ultrasonic dispersing machine for 1 minute. Next, 100 mL of an electrolyte solution and the dispersion liquid were placed in a beaker. The particle sizes of 30000 particles were measured at a concentration that allows measurement of the particle sizes of 30000 particles for 20 seconds. The volume average particle size was determined from the particle size distribution.

<Degree of Crystallization>

Using an X ray diffraction apparatus D8 DISCOVER with GADDS including a two-dimensional detector (made by Bruker Corporation), the X ray diffraction spectrum of the toner was measured.

For a capillary tube, a mark tube (Lindemann glass) having a diameter of 0.70 mm was used, and the capillary tube was filled with the toner to the upper portion of the tube for measurement. In filling with the toner, tapping was performed, and the number of tapping was 100.

The specific condition for measurement is shown below:

tube current: 40 mA
tube voltage: 40 kV
goniometer 2θ axis: 20.0000°
goniometer Ω axis: 0.0000°
goniometer ϕ axis: 0.0000°
detector distance: 15 cm (wide angle measurement)
measurement range: $3.2\leq2\theta[°]\leq37.2$
measurement time: 600 sec For a light emission optical system, a collimator having a pin hole with a diameter of 1 mm was used. The obtained two-dimensional data was integrated with the attached software (at a χ axis of 3.2° to 37.2°, and converted into one-dimensional data on diffraction intensity and 2θ. Based on the obtained X ray diffraction spectrum, the method for calculating a degree of crystallization is described below.

Figure 4A:
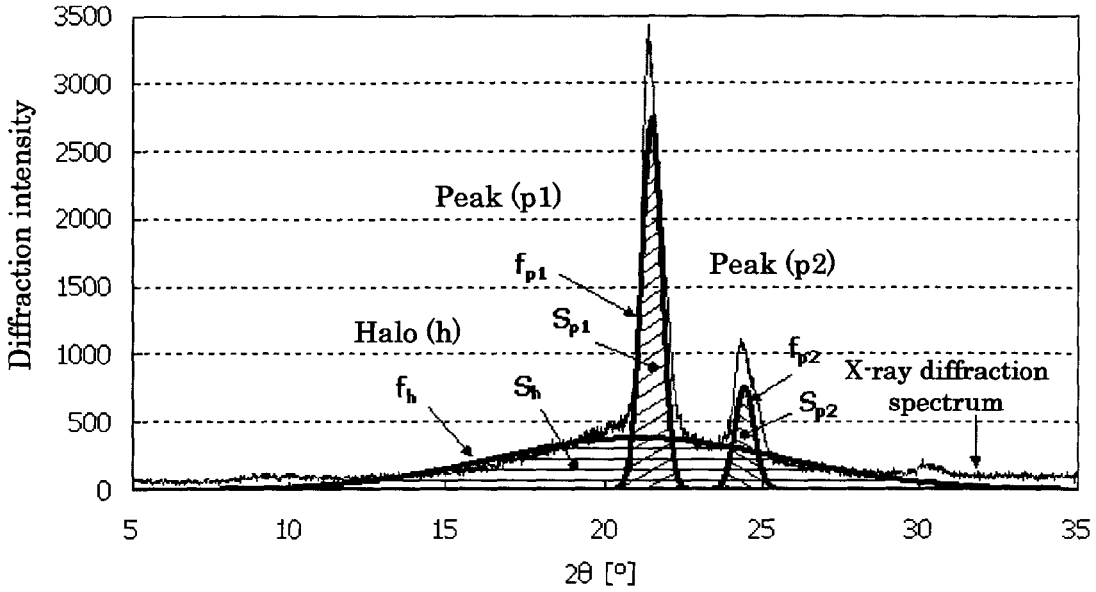
FIG. 4A is a drawing showing one example of an X ray diffraction spectrum of a toner.
Figure 4B:
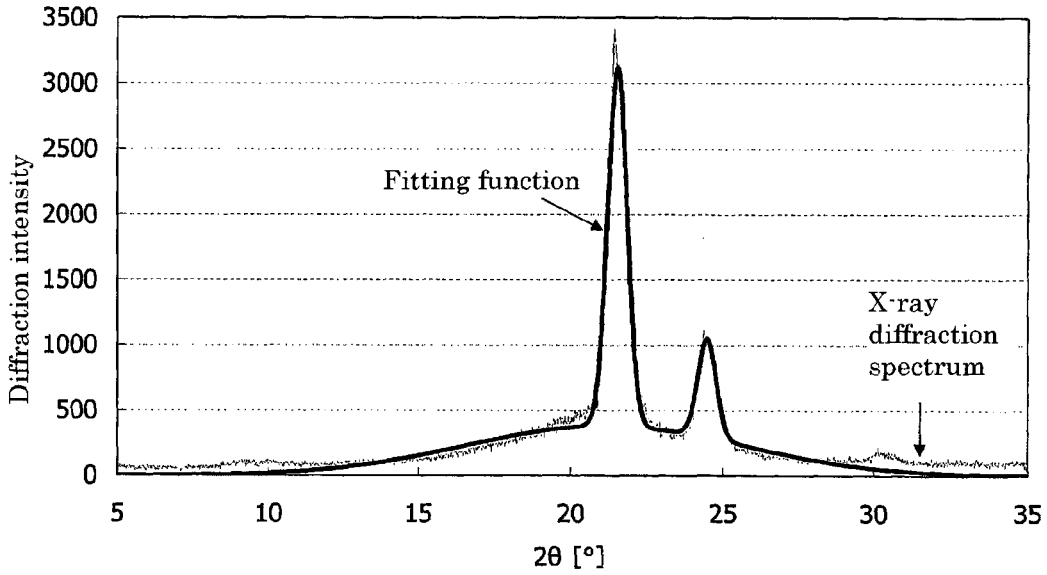
FIG. 4B is a drawing of an X ray diffraction spectrum obtained by fitting the X ray diffraction spectrum shown in FIG. 4A.

One example of an X ray diffraction spectrum of the toner is shown in FIG. 4. The abscissa designates 2θ, and the ordinate designates X ray diffraction intensity. Both are a linear axis. In the X ray diffraction spectrum in FIG. 4A, main peaks (p1 and p2) are found at 2θ=21.3° and 24.2°, and a halo (h) is seen in a wide range including these two peaks. Here, the main peaks are derived from the crystal structure, and the halo is derived from the non-crystalline structure.

The main peaks (p1 and p2) and the halo (h) are expressed by Gaussian functions:

$$f_{P1}(2\theta)=a_{p1}\exp(-(2\theta-b_{p1})^2/(2c_{p1}^2))$$

$$f_{P2}(2\theta)=a_{p2}\exp(-(2\theta-b_{p2})^2/(2c_{p2}^2))$$

$$f_h(2\theta)=a_h\exp(-(2\theta-b_h)^2/(2c_h^2));$$

and the sum of the three functions:

$$f(2\theta)=f_{p1}(2\theta)+f_{p2}(2\theta)+f_h(2\theta)$$

was defined as a fitting function for the entire X ray diffraction spectrum (see FIG. 4B), and fitting by the method of least squares was performed.

Nine fitting variables are $a_{p1}$, $b_{p1}$, $c_{p1}$, $a_{p2}$, $b_{p2}$, $c_{p2}$, $a_h$, $b_h$, and $c_h$. For initial values for fitting of the variables, the values obtained as follows were set: the position of the peak in the X ray diffraction spectrum (in FIG. 4A, $b_{p1}$=21.3, $b_{p2}$=24.2, and $b_h$=22.5) was input for $b_{p1}$, $b_{p2}$, and $b_h$, and numeric values were properly input for the other variables to match the main peaks and the halo with the X ray diffraction spectrum as much as possible. Fitting can be performed, for example, using the solver in Excel 2003 (made by Microsoft Corporation).

From the integrated areas ($S_{p1}$, $S_{p2}$, and $S_h$) of the Gaussian functions $f_{p1}(2\theta)$ and $f_{p2}(2\theta)$ corresponding to the two main peaks (p1 and p2) after fitting and the Gaussian function $f_h(2\theta)$ corresponding to the halo after fitting, the degree of crystallization [%] can be calculated by the expression: $(S_{p1}+S_{p2})/(S_{p1}+S_{p2}+S_h)\times 100$.

<$T_{sh\ 2nd}/T_{sh\ 1st}$>

Using a differential scanning calorimeter TA-60WS and DSC-60 (made by SHIMADZU Corporation), $T_{sh\ 2nd}$ and $T_{sh\ 1st}$ of the toner were measured. Specifically, first, 5.0 mg of the toner was placed in an aluminum sample container. The sample container was placed on a holder unit, and set inside of an electric furnace. Next, under a nitrogen atmosphere, the temperature was raised at a temperature raising rate of 10° C./rain from 0° C. to 150° C., and lowered at a cooling rate of 10° C./rain from 150° C. to 0° C. Further, the temperature was raised at a temperature raising rate of 10° C./min from 0° C. to 150° C., and the DSC curve was measured. Next, the point of intersection of the baseline on the side of the temperature lower than the endothermic peak and the tangent of an inclination on the low temperature side forming the endothermic peak was defined as $T_{sh\ 1st}$ for the endothermic peak in the first raising of the 1.5 temperature, and as $T_{sh\ 2nd}$ for the endothermic peak in the second raising of the temperature. At this time, if several endothermic peaks were found, the endothermic peak having the largest amount of heat to be absorbed was selected.

<Storage Elastic Modulus at 160° C.>

Using a dynamic rheometer ARES (made by TA Instruments-Waters LLC), the storage elastic modulus at 160° C. was measured. Specifically, first, the toner was molded into a pellet having a diameter of 8 mm and a thickness of 1 mm to 2 mm, and fixed to a parallel plate having a diameter of 8 mm. Next, the temperature was stabilized at 40° C., and raised to 200° C. at a temperature raising rate of 2.0° C./min, a frequency of 1 Hz (6.28 rad/s), and a strain amount of 0.1% (strain amount control mode). Then, the storage elastic modulus at 160° C. was measured.

<Average Circularity>

Using a flow type particle image analyzer ("FPIA-2100" made by Sysmex Corporation) and analysis software (FPIA-2100 Data Processing Program for FPIA version 00-10), the average circularity of the toner was measured. Specifically, first, 0.1 ml to 0.5 ml of a 10% by mass surfactant (alkylbenzene sulfonic acid salt) NEOGEN SC-A (made by Daiichi Kogyo Seiyaku Co., Ltd.) was placed in a 100 ml glass beaker, and 0.1 g to 0.5 g of the toner was added. These materials were stirred with a microspatula. Next, 80 mL of ion exchange water was added, and the materials were dispersed for 3 minutes using an ultrasonic disperser (made by Honda Electronics Co., Ltd.). The shape and distribution of the toner were measured until the concentration of the obtained dispersion liquid was 5000 particles/μL to 15000 particles/μL.

<Domain Diameter of Island>

The toner was buried in an epoxy resin, and solidified overnight. Then, using an ultramicrotome (made by Diatome AG), a section having a thickness of 120 nm was produced. Next, using a transmission electron microscope H7000 (made by Hitachi, Ltd.), the dispersion state of the pigment was observed. Further, the section was dyed with ruthenium tetraoxide, the sea island structure was observed in the same manner, and the domain diameter of the island was calculated. Specifically, after binarization, from the total area of islands existing in 20 toners and the number of islands, the average value of the equivalent circle diameter of the islands was calculated, and defined as the domain diameter of the island.

Next, the heat-resistant storage properties and low-temperature fixing properties of the toner, and saturation of an image were evaluated.

<Heat-Resistant Storage Properties>

A 50 mL glass container was filled with the toner, and left in a 50° C. thermostat for 24 hours. Then, the temperature was lowered to 24° C., and the penetration was measured according to a penetration test (JIS K2235-1991). Thus, heat-resistant storage properties were evaluated. A penetration of 25 mm or more was determined as A, a penetration of 15 mm or more and less than 25 mm was determined as B, a penetration of 10 mm or more and less than 15 mm was determined as C, and a penetration less than 10 mm was determined as F.

Next, using each of toners in Examples 1 to 23 and toners in Comparative Examples 1 to 3, a developer was produced.

<Production of Developer>

The toner was mixed with a carrier used for an imagio MP C4300 (made by Ricoh Company, Ltd.) such that the concentration of the toner was 5% by mass. Thus, a developer was obtained.

Next, using a developer, low-temperature fixing properties and saturation of an image were evaluated.

<Low-Temperature Fixing Properties>

Using an imagio MP C4300 (made by Ricoh Company, Ltd.), a solid image of 3 cm×8 cm having an amount of toner to be deposited of 0.85±0.1 mg/cm$^2$ was formed on a copy print paper <70> (made by Ricoh Business Expert Co., Ltd.). Then, the image was fixed by changing the temperature of a fixing belt. Next, using a drawing tester AD-401 (made by Ueshima Seisakusho Co., Ltd.), drawing was performed on the surface of the fixed image with a ruby probe having the radius of the tip of 260 μm to 320 μm, and the angle of the tip of 60° under the condition of a load of 50 g. Then, using a fiber HANICOT #440 (made by HANIRON K.K.), the drawn surface of the fixed image was rubbed strongly 5 times. A temperature of the fixing belt at which the image was hardly scraped was defined as a fixing lower limit temperature. At this time, the solid image was formed at a position 3.0 cm from the leading end in the sheet feeding direction, and the rate of passing through the nip portion of the fixing apparatus was 280 mm/s. A fixing lower limit temperature less than 105° C. was determined as A, a fixing lower limit temperature of 105° C. or more and less than 115° C. was determined as B, a fixing lower limit temperature of 115° C. or more and less than 125° C. was determined as C, and a fixing lower limit temperature of 130° C. or more was determined as F.

<Saturation of Image>

Using an imagio MP C4300 (made by Ricoh Company, Ltd.), a monochrome image having an area rate of 20% and an amount of the toner to be deposited of 0.40 mg/cm$^2$ was formed on an A4 size long grain paper T6000 70W (made by Ricoh Company, Ltd.). Then, using an X-Rite 938 (made by X-Rite, Incorporated), chromaticities a* and b* of the image were measured in a status A mode with d50 light. The saturation C* was calculated from the expression: $(a^{*2}+b^{*2})^{1/2}$.

The properties of the toner and results of evaluation are shown in Table 6 and Table 7, respectively.

TABLE 6

| | Degree of crystallization [%] | $T_{sh2nd}/T_{sh1st}$ | Storage elastic modulus at 160° C. [Pa] | Average circularity | Domain diameter of island [μm] |
|---|---|---|---|---|---|
| Ex. 1 | 21 | 0.98 | $5.7\times 10^3$ | 0.982 | 1.0 |
| Ex. 2 | 21 | 0.98 | $5.8\times 10^3$ | 0.983 | 1.2 |

TABLE 6-continued

| | Degree of crystal-lization [%] | $T_{sh2nd}/T_{sh1st}$ | Storage elastic modulus at 160° C. [Pa] | Average circu-larity | Domain diameter of island [μm] |
|---|---|---|---|---|---|
| Ex. 3 | 22 | 0.96 | $2.3 \times 10^3$ | 0.983 | 1.5 |
| Ex. 4 | 23 | 0.98 | $3.0 \times 10^3$ | 0.983 | 1.2 |
| Ex. 5 | 21 | 0.98 | $5.0 \times 10^3$ | 0.983 | 1.2 |
| Ex. 6 | 20 | 0.98 | $5.6 \times 10^3$ | 0.983 | 1.3 |
| Ex. 7 | 21 | 0.98 | $5.1 \times 10^3$ | 0.983 | 1.3 |
| Ex. 8 | 21 | 0.98 | $5.6 \times 10^3$ | 0.983 | 1.2 |
| Ex. 9 | 21 | 0.98 | $5.9 \times 10^3$ | 0.983 | 1.0 |
| Ex. 10 | 21 | 0.95 | $6.3 \times 10^3$ | 0.983 | 1.0 |
| Ex. 11 | 21 | 0.93 | $6.5 \times 10^3$ | 0.983 | 1.1 |
| Ex. 12 | 21 | 0.90 | $9.8 \times 10^3$ | 0.983 | 1.1 |
| Ex. 13 | 21 | 0.97 | $5.5 \times 10^3$ | 0.983 | 1.4 |
| Ex. 14 | 22 | 0.98 | $1.5 \times 10^3$ | 0.985 | 1.5 |
| Ex. 15 | 18 | 0.97 | $5.8 \times 10^3$ | 0.983 | 1.6 |
| Ex. 16 | 15 | 0.96 | $5.9 \times 10^3$ | 0.983 | 1.8 |
| Ex. 17 | 25 | 0.98 | $5.5 \times 10^3$ | 0.983 | 0.8 |
| Ex. 18 | 21 | 0.98 | $5.7 \times 10^3$ | 0.983 | 1.2 |
| Ex. 19 | 21 | 0.98 | $5.7 \times 10^3$ | 0.983 | 0.8 |
| Ex. 20 | 22 | 0.98 | $5.7 \times 10^3$ | 0.983 | 1.6 |
| Ex. 21 | 15 | 0.96 | $5.8 \times 10^3$ | 0.980 | 2.5 |
| Ex. 22 | 21 | 0.97 | $5.6 \times 10^3$ | 0.983 | 2.2 |
| Ex. 23 | 14 | 0.96 | $5.5 \times 10^3$ | 0.983 | 2.0 |
| Comp. Ex. 1 | 21 | 0.98 | $5.6 \times 10^3$ | 0.983 | 1.3 |
| Comp. Ex. 2 | 21 | 0.98 | $5.4 \times 10^3$ | 0.980 | — |
| Comp. Ex. 3 | 35 | 0.97 | $6.0 \times 10^3$ | 0.988 | — |

TABLE 7

| | Heat-resistant storage properties | Low-temper-ature fixing properties | Saturation of image |
|---|---|---|---|
| Ex. 1 | A | A | 93 |
| Ex. 2 | A | A | 91 |
| Ex. 3 | B | A | 102 |
| Ex. 4 | B | A | 100 |
| Ex. 5 | A | A | 99 |
| Ex. 6 | A | A | 94 |
| Ex. 7 | A | A | 97 |
| Ex. 8 | A | A | 95 |
| Ex. 9 | A | A | 91 |
| Ex. 10 | A | A | 89 |
| Ex. 11 | A | A | 89 |
| Ex. 12 | B | B | 87 |
| Ex. 13 | B | B | 91 |
| Ex. 14 | B | B | 102 |
| Ex. 15 | A | B | 92 |
| Ex. 16 | B | B | 90 |
| Ex. 17 | A | A | 92 |
| Ex. 18 | A | A | 75 |
| Ex. 19 | A | A | 62 |
| Ex. 20 | A | B | 93 |
| Ex. 21 | C | C | 92 |
| Ex. 22 | B | C | 90 |
| Ex. 23 | B | B | 92 |
| Comp. Ex. 1 | F | C | 83 |
| Comp. Ex. 2 | C | F | 83 |
| Comp. Ex. 3 | F | C | 84 |

From Table 6 and Table 7, it is understood that the toners in Examples 1 to 23 have the sea island structure formed in which the crystal region containing a crystalline resin is formed as a sea and the non-crystalline region containing the colorant therewithin is formed as an island, and attain excellent low-temperature fixing properties and heat-resistant storage properties, and high saturation of an image.

In contrast, the toner in Comparative Example 1 has the sea island structure formed, but the pigment is not contained in the island, and unevenly exists on the surface of the toner. As a result, low-temperature fixing properties, heat-resistant storage properties, and saturation of an image are reduced.

In the toners in Comparative Examples 2 and 3, no sea island structure is formed, and all the pigment unevenly exists. As a result, low-temperature fixing properties, heat-resistant storage properties, and saturation of an image are reduced.

Aspects according to the present invention are as follows, for example:

<1> A toner, including:

a crystalline resin; and a colorant, wherein the toner has a sea island structure in which a crystal region containing the crystalline resin is formed as a sea, and a non-crystalline region containing the colorant is formed as an island.

<2> The toner according to <1>, wherein a degree of crystallization of the toner is 12% or more.

<3> The toner according to <1> or <2>, wherein a storage elastic modulus at 160° C. of the toner is $1.0 \times 10^3$ Pa or more but $1.6 \times 10^4$ Pa or less.

<4> The toner according to any one of <1> to <3>, wherein the island has a domain diameter of 1.0 μm or more but 2.0 μm or less.

<5> The toner according to any one of <1> to <4>, wherein the crystalline resin contains a resin containing a polyester unit.

<6> The toner according to any one of <1> to <5>, wherein the crystalline resin contains a resin containing a urethane bond, a urea bond, or both in a main chain thereof.

<7> The toner according to <6>, wherein the crystalline resin contains a copolymer containing a polyester unit, and either a polyurethane unit or a polyurea unit.

<8> The toner according to any one of <1> to <7>, further including: a block copolymer containing a crystalline block and a non-crystalline block.

<9> The toner according to <8>, wherein the block copolymer is poorly soluble in ethyl acetate.

<10> The toner according to any one of <1> to <9>, wherein the crystalline resin contains a first crystalline resin, and a second crystalline resin having a weight average molecular weight larger than that of the first crystalline resin.

<11> A developer, including:

the toner according to any one of <1> to <10>.

<12> An image forming apparatus, including:

a photoconductor, a charging unit configured to charge the photoconductor, an exposing unit configured to expose the charged photoconductor to form an electrostatic latent image, a developing unit configured to develop the electrostatic latent image formed on the photoconductor with the toner according to any one of <1> to <10> to form a toner image, a transfer unit configured to transfer the toner image formed on the photoconductor onto a recording medium, and a fixing unit configured to fix the toner image transferred onto the recording medium.

REFERENCE SIGNS LIST

10 Photoconductor

30 Developing apparatus

100 Process cartridge
110 Photoconductor
130 Developing apparatus

The invention claimed is:

1. A toner, comprising:
a crystalline resin; and
a colorant,
wherein the toner has a sea island structure in which a crystal region comprising the crystalline resin is formed as a sea, and a non-crystalline region comprising the colorant is formed as an island,
wherein the island has a domain diameter of from 1.1 μm to 2.0 μm, and
wherein the toner has a storage elastic modulus at 160° C. of from $1.0\times10^3$ Pa to $1.6\times10^4$ Pa.

2. The toner according to claim 1,
wherein a degree of crystallization of the toner is 12% or more.

3. The toner according to claim 1,
wherein the toner has a storage elastic modulus at 160° C. of from $5.0\times10^3$ Pa to $1.0\times10^4$ Pa.

4. The toner according to claim 1,
wherein the island has a domain diameter of from 1.1 μm to 1.5 μm.

5. The toner according to claim 1,
wherein the crystalline resin comprises a resin comprising a polyester unit.

6. The toner according to claim 1,
wherein the crystalline resin comprises a resin comprising a urethane bond, a urea bond, or both in a main chain thereof.

7. The toner according to claim 6,
wherein the crystalline resin comprises a copolymer comprising a polyester unit, and either a polyurethane unit or a poly-urea unit.

8. The toner according to claim 1, further comprising:
a block copolymer comprising a crystalline block and a non-crystalline block.

9. The toner according to claim 8,
wherein the block copolymer is poorly soluble in ethyl acetate.

10. The toner according to claim 1,
wherein the crystalline resin comprises a first crystalline resin, and a second crystalline resin having a weight average molecular weight larger than that of the first crystalline resin.

11. A developer, comprising:
a toner,
wherein the toner comprises:
a crystalline resin; and
a colorant,
wherein the toner has a sea island structure in which a crystal region comprising the crystalline resin is formed as a sea, and a non-crystalline region comprising the colorant is formed as an island,
wherein the island has a domain diameter of from 1.1 μm to 2.0 μm, and
wherein the toner has a storage elastic modulus at 160° C. of from $1.0\times10^3$ Pa to $1.6\times10^4$ Pa.

* * * * *